US006053596A

United States Patent [19]

Nakano et al.

[11] Patent Number: 6,053,596

[45] Date of Patent: Apr. 25, 2000

[54] INK-JET PRINTING DEVICE AND DRIVING CIRCUIT USED IN THE INK-JET PRINTING DEVICE

[75] Inventors: Tomoaki Nakano, Kawasaki; Kouji Izumi, Yokohama, both of Japan

[73] Assignee: Ricoh Company, Ltd., Tokyo, Japan

[21] Appl. No.: 08/821,665

[22] Filed: Mar. 19, 1997

[30] Foreign Application Priority Data

Mar. 22, 1996 [JP] Japan ..... 8-066846
Apr. 18, 1996 [JP] Japan ..... 8-096954

[51] Int. Cl.[7] ..... B41J 2/205

[52] U.S. Cl. ..... 347/15; 347/9

[58] Field of Search ..... 347/9, 15, 10, 347/12, 43; 358/298

[56] References Cited

U.S. PATENT DOCUMENTS

| | | | |
|---|---|---|---|
| 5,142,296 | 8/1992 | Lopez et al. | 347/12 |
| 5,221,931 | 6/1993 | Moriyama | 347/10 |
| 5,266,965 | 11/1993 | Komai et al. | 347/12 |
| 5,285,215 | 2/1994 | Liker | 347/11 |
| 5,416,612 | 5/1995 | Ingraham et al. | 358/501 |
| 5,617,123 | 4/1997 | Takaoka et al. | 347/15 |
| 5,777,640 | 7/1998 | Shioya et al. | 347/15 |

FOREIGN PATENT DOCUMENTS

| | | | |
|---|---|---|---|
| 57-160654 | 10/1982 | Japan | B41J 3/04 |
| 59-42965 | 3/1984 | Japan | B41J 3/04 |
| 62-267150 | 11/1987 | Japan | B41J 3/04 |
| 63-251241 | 10/1988 | Japan | B41J 3/04 |

OTHER PUBLICATIONS

Ross R. Allen, Black and Color Resolution Enhancement Technology used in the Hewlett–Packard DeskJet 850C Printer, Proceedings of IS&T's Eleventh International Congress on Advances in Non–Impact Printing Technologies, pp 356–358.

*Primary Examiner*—John Barlow
*Assistant Examiner*—Craig A. Hallacher
*Attorney, Agent, or Firm*—Cooper & Dunham LLP

[57] ABSTRACT

An ink-jet printing device includes a recording head driven by a driving voltage waveform in a main scanning direction for recording an image on a recording medium fed into the printing device in a subscanning direction. A voltage level of the driving voltage waveform is controlled such that the voltage value is constant through a single scan of the recording head in the main scanning direction and different between different scans of the recording head in the main scanning direction.

22 Claims, 26 Drawing Sheets

FIRST SCAN

SECOND SCAN

THIRD SCAN

FIRST SCAN

SECOND SCAN

THIRD SCAN

FIG.19
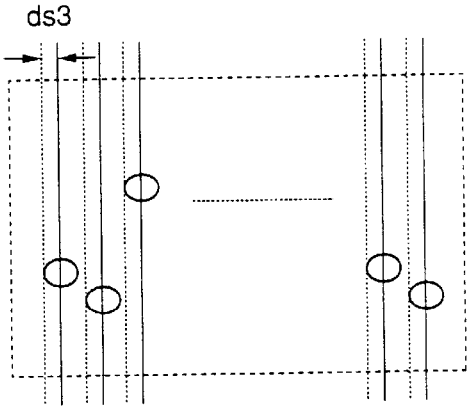
FIG.20A
FIG.20B
FIG.20C
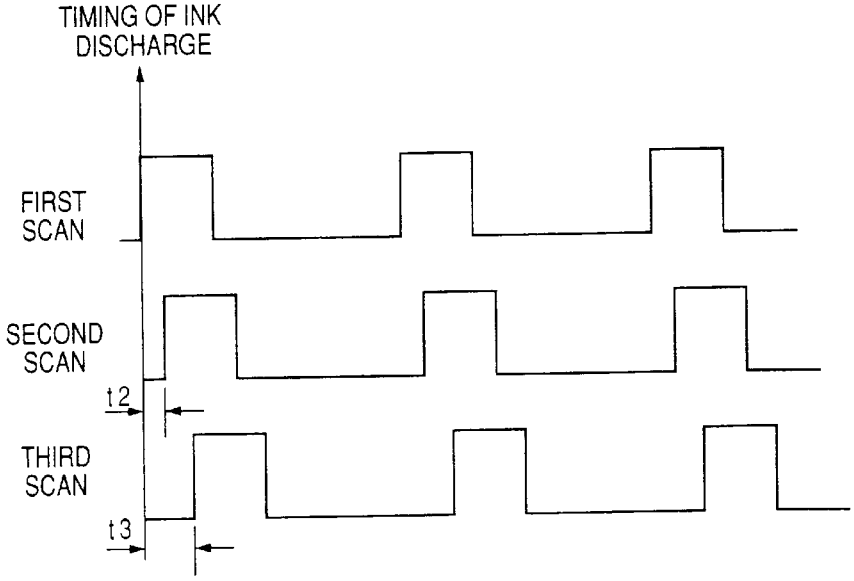

INK-JET PRINTING DEVICE AND DRIVING CIRCUIT USED IN THE INK-JET PRINTING DEVICE

BACKGROUND OF THE INVENTION

1. Field of the Invention

The present invention relates to an ink-jet recording device, a driving circuit for an ink-jet printing head and a method for driving the ink-jet printing head. More particularly, the present invention relates to a serial type ink-jet recording device, a driving circuit for a color ink-jet printing head and a method for driving the color ink-jet printing head.

2. Description of the Related Art

Ink jet printing has attracted special attention since it is capable of printing an image on plain paper without contact of the printing head with the paper. Generally, an ink jet printer system uses a simple printing process and makes almost no vibration and noise during an operation. Also, the ink jet printer system can be suitably applied to color image printing. Thus, the ink jet printer system is considered as being advantageous over other existing printing systems.

These days, an ink jet printer system using ink-jet printing heads is widely used as, for instance, a printer for a computer, facsimile, a word processor, and scientific instruments. In piezoelectric type ink jet printing heads, a piezoelectric actuator is used to force out ink drops from nozzles in accordance with print signals by applying a force to ink within ink chambers through actuation of an actuator. In this manner, dots of ink drops are formed and an image may be recorded on a recording medium with a high speed, high resolution and high quality.

Some ink-jet printing device using a piezoelectric actuator have a structure in which piezoelectric elements are actuated by selecting an appropriate pulse from a pulse group comprising a plurality of voltage pulses as disclosed in Japanese Laid-Open Patent Application No.57-160654. Ink drops forced out from respective nozzles by the movement of the thus actuated piezoelectric actuator are combined together in the air to form one ink drop of various colors and is applied to a recording medium to make a dot of the color on the recording medium.

Also, as disclosed in Japanese Laid-Open Patent Application No.62-267150, some ink-jet printing device have a structure in which the volume of an ink drop is controlled so that a color tone of a pixel is distinctively increased in accordance with an increment of input signals of optical density for each of the ink-jet printing heads having nozzles of different sizes, and one pixel is filled with one or more ink drops ejected from the nozzles of different size.

Moreover, Japanese Laid-Open Patent Application No.63-251241 discloses an ink-jet printing device having a signal changing unit which changes a falling-time constant of a driving pulse, which is used for returning an ink chamber to an initial state, in accordance with a voltage value so that the return of a meniscus of the nozzle proceeds at a proper speed without exceeding a predetermined distance after a discharging process of ink drops from nozzles of the ink chamber, which is carried out by rapidly decreasing the volume of the ink chamber (or rapidly increasing the pressure of the ink chamber).

Further, Japanese Laid-Open Patent Application No.59-42965 discloses an ink-jet printer, in which ink drops are discharged by pressurizing ink contained in an ink chamber by applying a pulse voltage to piezoelectric elements, having an adjusting means which is capable of adjusting at least one of a pulse rising-time and time of the pulse.

However, as for the above-mentioned ink-jet printing device in which the piezoelectric elements are actuated by selecting an appropriate pulse from a pulse group, the number of electric circuits of a driving circuit are necessary for selecting the appropriate pulse, which correspond to each of the piezoelectric elements, is increased when the number of nozzles used for an ink-jet printing head is increased. Thus, high-integration of an ink-jet printing head may become difficult to achieve. Also, the size of the entire driving circuit becomes large and the number of leads used for connecting each circuit is accordingly increased. This may lead to an increase of the manufacturing cost of the ink-jet printing device.

Moreover, according to the above-mentioned ink-jet printing device disclosed in Japanese Laid-Open Patent Application No.62-267150, since a pixel is filled by continuously ejecting ink drops using a certain number of pulse groups, the response frequency of the ink ejection is necessarily multiplied by the spatial frequency of a pixel formed on a recording medium, and hence an extremely high response frequency is required.

As for the ink-jet printing device disclosed in Japanese Laid-Open Patent Application No.63-251241, since the falling-time constant is not significantly changed when a pulse voltage is large, the return of a meniscus does not exceed a predetermined distance if a volume of discharged ink is increased. However, if the pulse voltage is raised, the volume of discharged ink is increased due to the increase of energy to the piezoelectric elements regardless of the falling-time constant and unnecessary satellite ink drops are generated. Thus, the recording position of an ink drop on a recording medium is different when the pulse voltage is raised or increased, and hence a positioning accuracy of a dot and image quality produced is deteriorated.

With regard to the ink-jet printer disclosed in Japanese Laid-Open Patent Application No.59-42965, the pulse voltage may be optimized by adjusting the rising-time or the duration of the pulse voltage. However, when it is necessary to change the pulse voltage in order to change a dot size or to control the dot size by changing a volume of discharged ink according to a type of recording medium or ink used, it is not possible to stably discharge the ink by adjusting the rising-time or the duration of the pulse.

SUMMARY OF THE INVENTION

Accordingly, it is a general object of the present invention to provide an ink-jet recording device, a driving circuit for an ink-jet printing head and a method for driving the ink-jet printing head, in which the above-mentioned problems are eliminated.

A more specific object of the present invention is to provide a serial type ink-jet recording device, a driving circuit for a color ink-jet printing head and a method for driving the color ink-jet printing head, in which the above-mentioned problems are eliminated.

Another object of the present invention is to provide an ink-jet recording device and a driving circuit which has a simple structure yet is capable of producing an image of various color tones.

It is another object of the present invention to provide an ink jet recording device and a driving circuit, by which the printing speed of the device may be increased and a high quality color tone image may be obtained at low cost with a simple control of the driving circuit.

It is still another object of the present invention to provide a method for driving an ink-jet printing head and a driving circuit used therein by which an image of high quality may be obtained by stably discharging ink drops.

The objects described above are achieved by an ink-jet printing device which performs a recording of an image on a recording medium by moving a recording head in a main scanning direction and feeding the recording medium in a sub-scanning direction, comprising a means for producing ink dots of different sizes on the recording medium by superimposing an ink drop onto another ink drop during a plurality of scans of the recording head.

According to the above ink-jet printing device, since a means for producing ink dots of different sizes on the recording medium by superimposing an ink drop onto another during a plurality of scans of the recording head is provided, dots of multi-levels may be easily produced on a recording medium and a high quality color tone image may be obtained at low cost.

The objects described above are achieved by an ink-jet printing device which performs a recording of an image on a recording medium by moving a recording head in a main scanning direction and feeding the recording medium in a sub-scanning direction, comprising a means for shifting a deposition or landing position of an ink drop for a pixel from the deposition or landing position of other ink drops for the pixel in at least one scan from among a plurality of scans of the recording head.

According to the above ink-jet printing device, since a means for shifting a deposition position of an ink drop for a pixel from the deposition position of other ink drops for the pixel in at least one scan from among a plurality of scans of the recording head is provided, dots of multi-levels may be easily produced on a recording medium and a high quality color tone image may be obtained at low cost.

The objects described above are also achieved by the ink-jet printing device, wherein a driving timing of the at least one scan from among a plurality of scans of the recording head is different from the driving timing of other scans within a pitch between two vertical lines of pixels.

According to the above ink-jet printing device, since a driving timing of the at least one scan of the recording head is different from the driving timing of other scans within a pitch between two vertical lines of pixels, i.e., the driving timing may be varied at each scan and not varied during a main scan, dots of multi-levels may be easily produced on a recording medium with a simple control of a head driving circuit and a high quality color tone image may be obtained at low cost.

The objects described above are also achieved by the ink-jet printing device, wherein a feeding amount of the recording medium of the at least one scan of the recording head is different from the feeding amount of other scans within a pitch between two horizontal lines of pixels.

According to the above ink-jet printing device, since a feeding amount of the recording medium of the at least one scan of the recording head is different from the feeding amount of other scans within a pitch between two horizontal lines of pixels, i.e., the feeding amount of the recording medium may be varied at each scan and not varied during a main scan, dots of multi-levels may be easily produced on a recording medium with a simple control of a sub-scanning motor and a high quality color tone image may be obtained at low cost.

The objects described above are achieved by an ink-jet printing device which performs a recording of an image on a recording medium by moving a recording head in a main scanning direction and feeding the recording medium in a sub-scanning direction, comprising a means for varying a volume of a discharged ink drop for a pixel from the volume of other ink drops for the pixel in at least one scan of a plurality of scans of the recording head.

According to the above ink-jet printing device, since a means for varying a volume of a discharged ink drop for a pixel from the volume of other ink drops for the pixel in at least one scan of a plurality of scans of the recording head is provided, dots of multi-levels may be easily produced on a recording medium and a high quality color tone image may be obtained at low cost.

The objects described above are also achieved by the ink-jet printing device, wherein a driving waveform of the at least one scan of a plurality of scans of the recording head is different from the driving waveform of other scans.

According to the above ink-jet printing device, since a driving waveform of the at least one scan of a plurality of scans of the recording head is different from the driving waveform of other scans, i.e., the driving waveform may be varied at each scan and not varied during a main scan, dots of multi-levels may be easily produced on a recording medium with a simple control of a head driving circuit and a high quality color tone image may be obtained at low cost.

The objects described above are also achieved by the ink-jet printing device, wherein a driving voltage of the at least one scan of a plurality of scans of the recording head is different from the driving voltage of other scans.

According to the above ink-jet printing device, since a driving voltage of the at least one scan of a plurality of scans of the recording head is different from the driving voltage of other scans, i.e., the driving voltage may be varied at each scan and not varied during a main scan, dots of multi-levels may be easily produced on a recording medium with a simple control of driving voltage and a high quality color tone image may be obtained at low cost.

The objects described above are also achieved by the ink-jet printing device, wherein a rising-time constant for a driving waveform of the at least one scan of a plurality of scans of the recording head is different from the rising-time constant for a driving voltage of other scans.

According to the above ink-jet printing device, since a rising-time constant for a driving waveform of the at least one scan of a plurality of scans of the recording head is different from the rising-time constant for a driving voltage of other scans, i.e., the rising-time constant may be varied at each scan and not varied during a main scan, dots of multi-levels may be easily produced on a recording medium with a simple control of a head driving circuit and a high quality color tone image may be obtained at low cost.

The objects described above are achieved by an ink-jet printing device which performs a recording of an image on a recording medium by moving a recording head in a main scanning direction and feeding the recording medium in a sub-scanning direction, comprising a means for shifting a landing or deposition position of an ink drop for a pixel from the landing or deposition position of other ink drops for the pixel and for varying a volume of discharged ink drop for the pixel from the volume of other ink drops for the pixel in at least one scan of a plurality of scans of the recording head.

According to the above ink-jet printing device, since a means for shifting a deposition position of an ink drop for a pixel from the deposition position of other ink drops for the pixel and for varying a volume of discharged ink drop for the pixel from the volume of other ink drops for the pixel in at least one scan of a plurality of scans of the recording head is provided, dots of multi-levels may be easily produced on a recording medium with a relatively small volume and small shift in landing or deposition position of an ink drop, and a high quality color tone image may be produced by such dots.

The objects described above are also achieved by the ink-jet printing device, wherein a driving waveform of the at least one scan of a plurality of scans of the recording head is different from the driving waveform of other scans.

According to the above ink-jet printing device, since a driving waveform and/or driving timing of the at least one scan of a plurality of scans of the recording head is different from the driving waveform and/or driving timing of other scans, dots of multi-levels may be easily produced on a recording medium with a simple control of a head driving circuit and a high quality color tone image may be obtained at low cost.

The objects described above are also achieved by the ink-jet printing device, wherein the recording head is comprised of one of a plurality of heads and a plurality of nozzles, which may be divided into a plurality of blocks, and a means for making each of the blocks discharge ink drops using different waveforms and different driving timings for each of the blocks is further provided.

According to the above ink-jet printing device, since the recording head is comprised of one of a plurality of heads and a plurality of nozzles, which may be divided into a plurality of blocks, and a means for making each of the blocks discharge ink drops using different waveforms and different driving timings for each of the blocks is further provided, the number of main scans required for producing dots of multi-levels may be reduced in accordance with the number of blocks. Thus, the printing speed of a device may be increased and a high quality color tone image may be obtained at low cost with a simple control of a head driving circuit.

The objects described above are achieved by a method for recording an image on a recording medium using an ink-jet printing device in which a recording head is moved in a main scanning direction and said recording medium is fed in a sub-scanning direction and ink dots of different sizes are formed on said recording medium by superimposing an ink drop onto another during a plurality of scans of said recording head, comprising a step of shifting a landing or deposition position of an ink drop for a pixel from the landing or deposition position of other ink drops for said pixel in at least one scan of a plurality of scans of said recording head.

According to the above method, since a step of shifting a landing or deposition position of an ink drop for a pixel from the landing or deposition position of other ink drops for said pixel in at least one scan of a plurality of scans of said recording head is included, dots of multi-levels may be easily produced on a recording medium and a high quality color tone image may be obtained at low cost.

The objects described above are achieved by a method for driving an ink-jet printing head which uses a piezoelectric element as an actuator, wherein a voltage and a rising-time constant of a driving voltage waveform which actuates the piezoelectric element are dependently varied.

According to the above method, since a voltage and a rising-time constant of a driving voltage waveform which actuates the piezoelectric element are dependently varied, ink drops may be discharged from nozzles in a stable condition at all times and an image of high color quality having no satellite ink drops may be produced.

The objects described above are also achieved by the method for driving an ink-jet printing head, wherein the rising-time constant is increased when the voltage of the driving voltage waveform is increased.

According to the above method, since the rising-time constant is increased when the voltage of the driving voltage waveform is increased, a velocity of discharged ink may be kept constant if the driving voltage is varied, and hence accuracy in positioning of dots may be improved.

The objects described above are also achieved by the method for driving an ink-jet printing head, wherein a combination of the voltage and the rising-time constant is selected from among a plurality of combinations of the voltage and the rising-time constant in accordance with a control mode.

According to the above method, since a combination of the voltage and the rising-time constant is selected from among a plurality of combinations of the voltage and the rising-time constant in accordance with a control mode, it is possible to control a driving circuit using digital information from a CPU. Thus, a highly precise control may be achieved at a low cost with a simple structure of a circuit.

The objects described above are achieved by a driving circuit for an ink-jet printing head which uses a piezoelectric element as an actuator, comprising a waveform generating means which generates voltage waveforms for actuating the piezoelectric element, wherein a voltage and a rising-time constant of a driving voltage waveform which actuates the piezoelectric element are dependently varied.

According to the above driving circuit, since a waveform generating means which generates voltage waveforms for actuating the piezoelectric element is provided and a voltage and a rising-time constant of a driving voltage waveform which actuates the piezoelectric element are dependently varied, it is not necessary to control the waveform for each actuator and only the control of the driving voltage and the rising-time constant of a common driving waveform is necessary. Therefore, a circuit having fewer parts may be constructed at a low cost.

The objects described above are also achieved by the driving circuit for an ink-jet printing head comprising a plurality of resistance elements which determines a rising-time constant of the driving voltage waveform, wherein some resistance elements from among the plurality of resistance elements are selected in accordance with a driving voltage.

According to the above driving circuit, since a plurality of resistance elements which determines a rising-time constant of the driving voltage waveform is provided and some resistance elements from among the plurality of resistance elements are selected in accordance with a driving voltage, it is possible to control the rising-time constant by selecting a resistance element using a switching element, and hence a circuit may be constructed at low cost.

The objects described above are also achieved by the driving circuit for an ink-jet printing head, further comprising a voltage control means which varies a voltage of the driving voltage waveform in accordance with a digital output value of a CPU, and a time constant control means for selecting the resistance elements which determine the rising-time constant in accordance with a digital output value of a CPU.

According to the above driving circuit, since a voltage control means which varies a voltage of the driving voltage waveform in accordance with a digital output value of a CPU, and a time constant control means for selecting the resistance elements which determine the rising-time constant in accordance with a digital output value of a CPU are provided, the driving voltage and the rising-time constant may be controlled by bit information of a CPU. Thus, a plurality of modes (eg. environmental temperature, dot size, type of paper) may be easily controlled by a CPU with reference to a ROM (stored table).

The objects described above are also achieved by the driving circuit for an ink-jet printing head, wherein a thermistor is comprised of one of the voltage control means and the time constant control means.

According to the above driving circuit, since a thermistor is comprised of one of the voltage control means and the time constant control means, the driving voltage and the rising-time constant may be readily controlled by exchanging a resistance with the thermistor when the ink discharging characteristics of a printing head related to a environmental temperature is corrected by the driving waveform.

Other objects and further features of the present invention will be apparent from the following detailed description when read in conjunction with the accompanied drawings.

BRIEF DESCRIPTION OF THE DRAWINGS

FIG. 19 is a diagram for explaining a formation process of a printed pattern according to the second embodiment of the present invention;

FIG. 20A is a diagram for explaining a driving timing of the head driving circuit according to the second embodiment of the present invention;

FIG. 20B is a diagram for explaining a driving timing of the head driving circuit according to the second embodiment of the present invention;

FIG. 20C is a diagram for explaining a driving timing of the head driving circuit according to the second embodiment of the present invention;

DETAILED DESCRIPTION OF THE PREFERRED EMBODIMENTS

An ink-jet recording device, a driving circuit for a ink-jet printing head and a method for driving the ink-jet printing head according to the present invention will be described in detail hereinafter.

Figure 1:
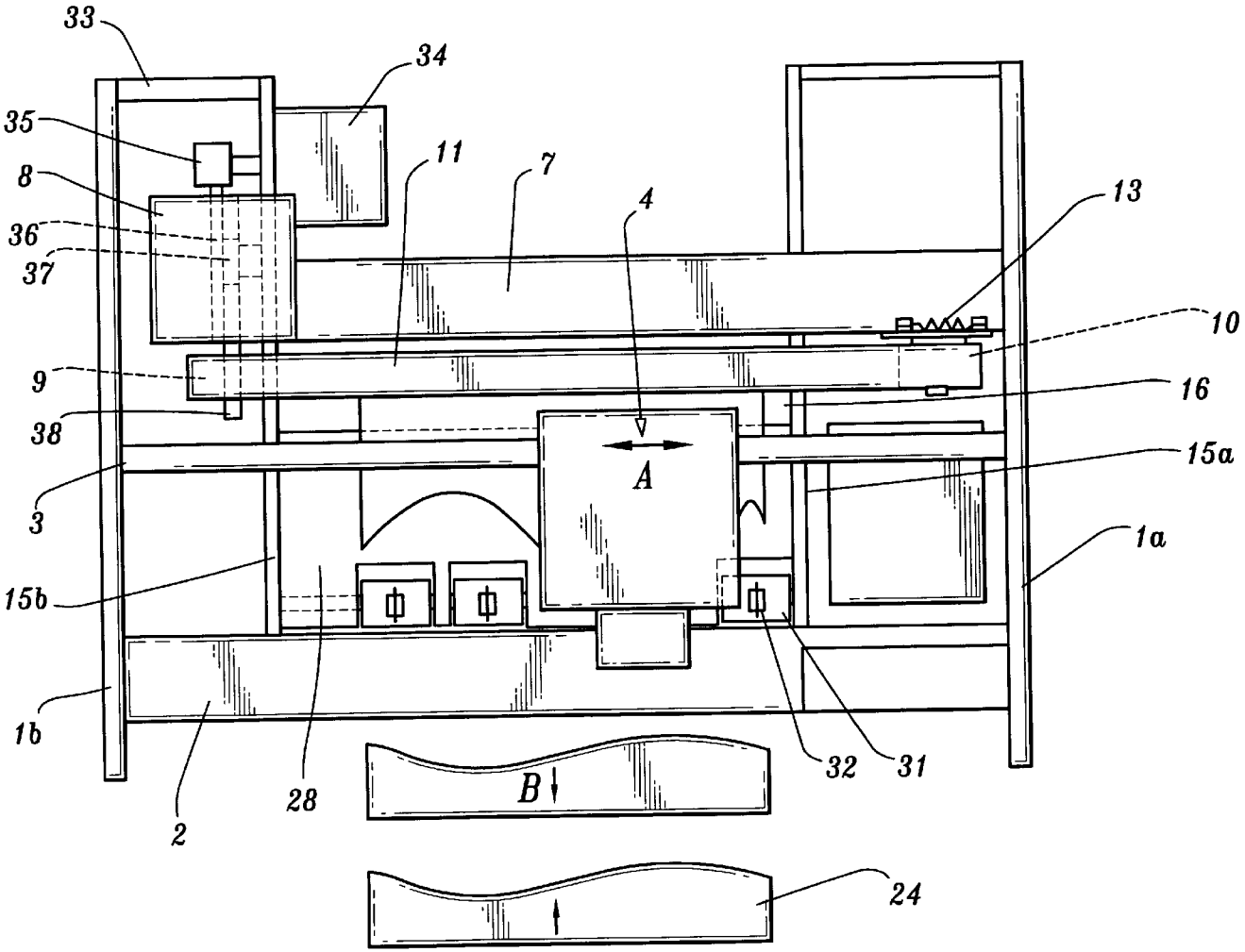
FIG. 1 is a diagram showing a schematic plan view of an ink-jet printing device to which the present invention is applied.
Figure 2:
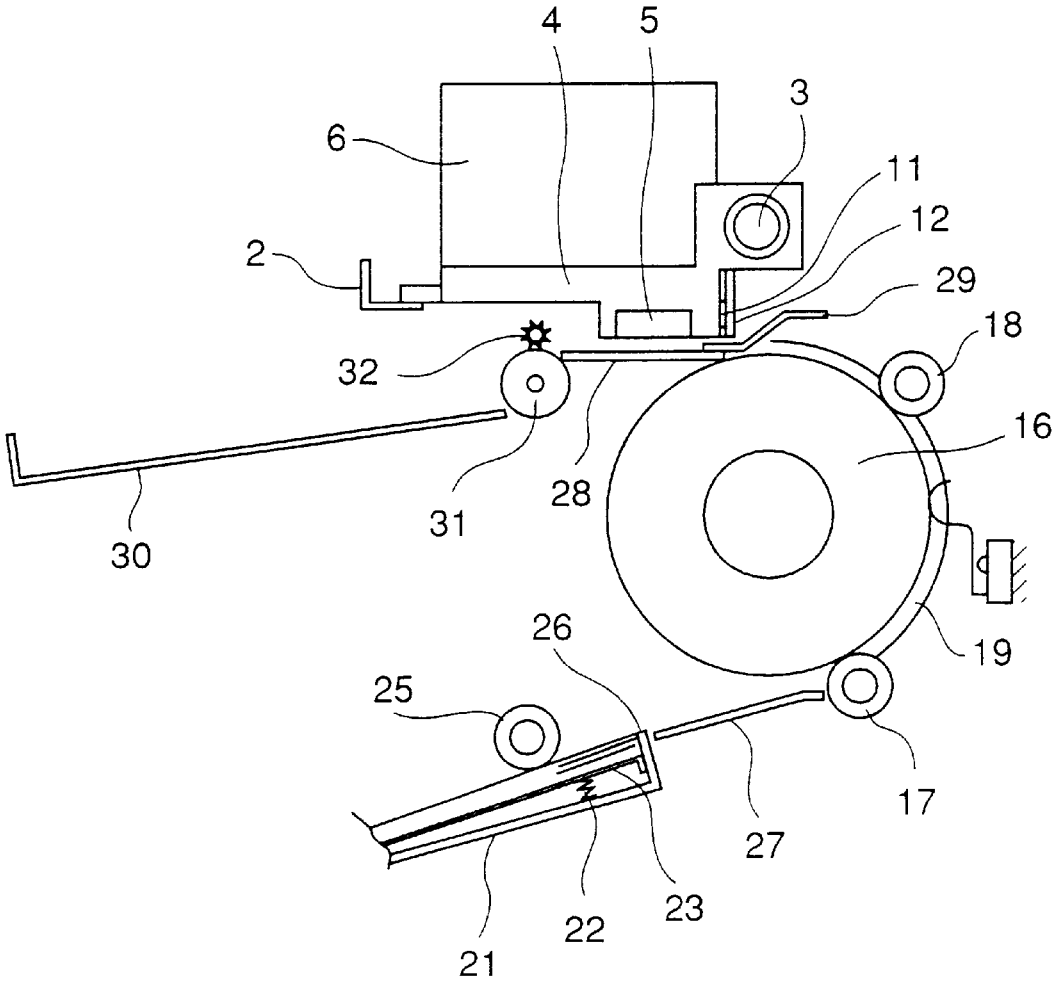
FIG. 2 is a diagram showing a schematic side view of the ink-jet printing device shown in FIG. 1.

FIG. 1 is a diagram showing a schematic plan view of an ink-jet printing device to which the present invention is applied, and FIG. 2 is a diagram showing a schematic side view of the ink-jet printing device.

The ink-jet printing device is comprised of, as shown in FIGS. 1 and 2, a right main scanning frame 1*a,* a left main scanning frame 1*b,* a front guide 2, a guide shaft 3, a carriage 4, a recording head 5, an ink cartridge 6, a stay 7, a motor 8, a motor pulley 9, a side pulley 10, a belt 11, a belt clamp 12, a tension spring 13, a right sub-scanning frame 15*a,* a left sub-scanning frame 15*b,* a platen 16, carrier rollers 17 and 18, a paper pan 19, a paper feeding tray 21, a spring 22, a moving tray 23, a paper 24, a paper feeding roller 25, a corner hook 26, a paper feeding guide 27, a paper guide 28, a paper presser 29, a paper receiving tray 30, a paper ejecting roller 31, a subsidiary roller 32, a sub-frame 33, a sub-scanning motor 34, a rotary shaft 34, a motor gear 35, idler gears 36 and 37, and a platen gear 38.

The carriage 4 is movably mounted on the front guide 2 and the guide shaft 3 which are provided between the right and the left main scanning frames 1*a* and 1*b.* The recording head 5 comprising a plurality of ink-jet printing heads is provided with the lower surface of the carriage 4 and the ink cartridge 6 is detachably provided with the upper surface of the ink cartridge 6.

The motor 8 is set on the stay 7 having a substantially L-shape, which is provided between the right and the left main scanning frames 1*a* and 1*b* and the belt 11 is provided between the motor pulley fixed on the rotary shaft of the main scanning motor 8 and the side pulley 10 fixed on the stay 7. The carriage 4 is fixed to the belt 11 using the belt clamp 12 as shown in FIG. 2 so that the carriage 4 is scanned in the direction indicated by the arrow A shown in FIG. 1 (main scanning direction) when the main scanning motor 8 is actuated. Also, the side pulley 10 is provided so as to make it possible to move slightly in the main scanning direction and the tension spring 13 applies a tension on the belt 11.

On the other hand, as shown in FIG. 2, the platen 16 is rotatably supported between the right and the left sub-scanning frames 15*a* and 15*b* and the carrier rollers 17 and 18, which are pressed to the platen 16, and the paper pan 19, which guides a paper along the platen 16, are provided. Thus, the paper 24, which is a recording medium and is set in the moving tray 23 supported by the spring 22 in the paper feeding tray 21, may be fed one sheet by one sheet by the paper feeding roller 25 and the corner hook 26 provided with the paper feeding tray 21 and the paper 24 is guided to the platen 16 along the paper feeding guide 27.

The paper guide 28 is provided in the vicinity of the outlet of the platen 16 so as to oppose the carriage 4 and the paper presser 29 for pressing the paper 24 supplied from the platen 16 is provided in the vicinity of the inlet of the paper guide 28. The paper ejecting roller 31 and the subsidiary roller 32 for ejecting the paper 24 to the paper receiving tray 30 are provided in the vicinity of the outlet of the paper guide 28.

Moreover, the sub-scanning motor 34 is provided with the sub-frame 33, which is fixed to the main scanning frame 1*a* and 1*b,* respectively, and, as shown in FIG. 1, the motor gear 35 is fixed to the rotary shaft 34 of the sub-scanning motor 34. The idler gear 36 is engaged with the motor gear 35 and the idler gear 37, which is used in combination with the idler gear 36, is engaged with the platen gear 38 which is fixed to the platen 16. Thus, the rotation of the sub-scanning motor 34 may be transmitted to the platen 16 and each of the rollers, and the paper 24 is carried in the direction indicated by the arrow B shown in FIG. 1 (sub-scanning direction) on the paper guide 28 by the rotation of the platen 16 and each of the rollers.

The ink-jet printing device having the above-mentioned structure is capable of recording an image on the paper 24 by ejecting ink drops from nozzles of the recording head 5 when the paper 24 is moved in the sub-scanning direction while the recording head 5 is moved in the main scanning direction.

Figure 3:
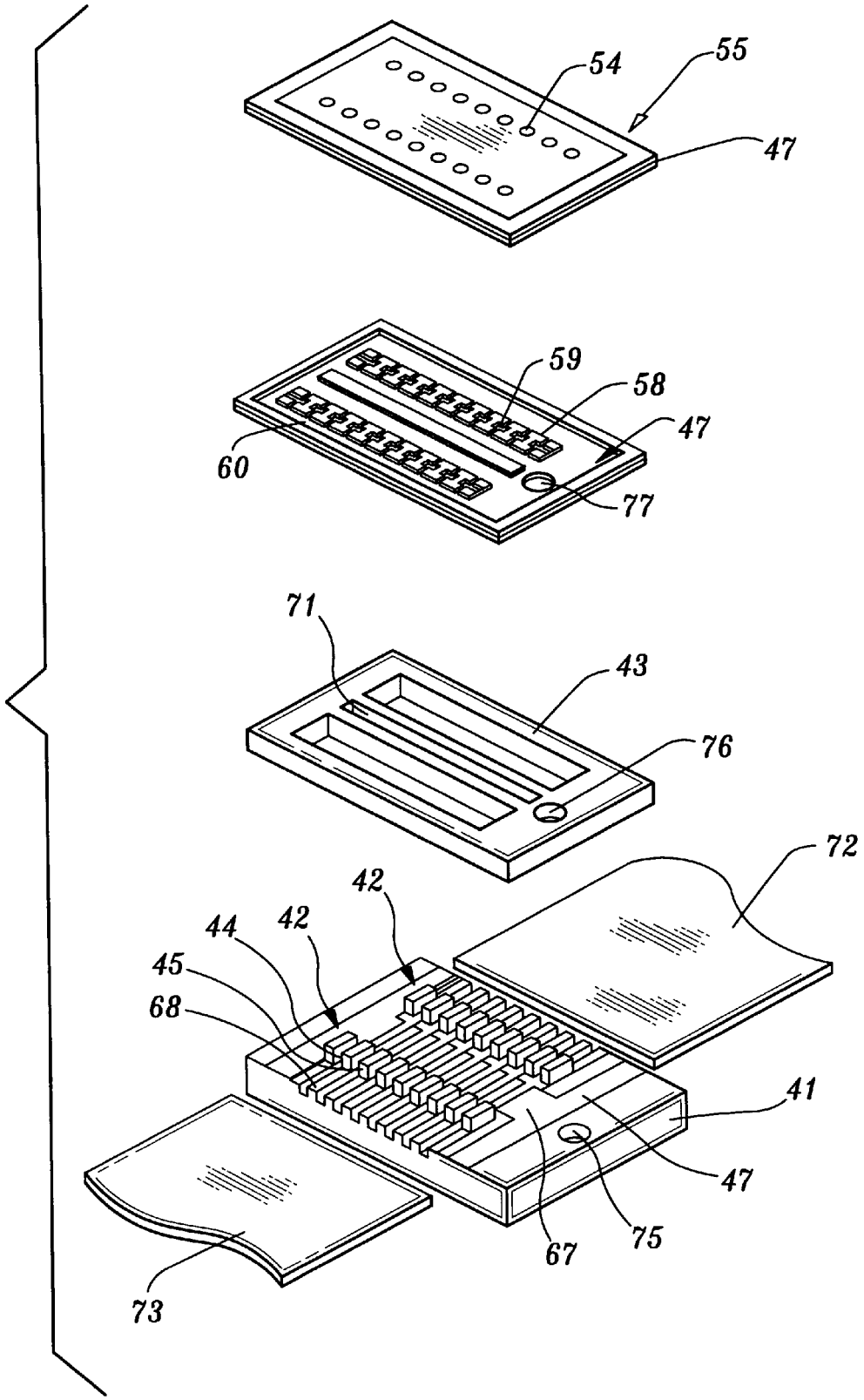
FIG. 3 is a diagram showing an exploded perspective view of an ink-jet printing head to be used in an ink-jet printing device.
Figure 4:
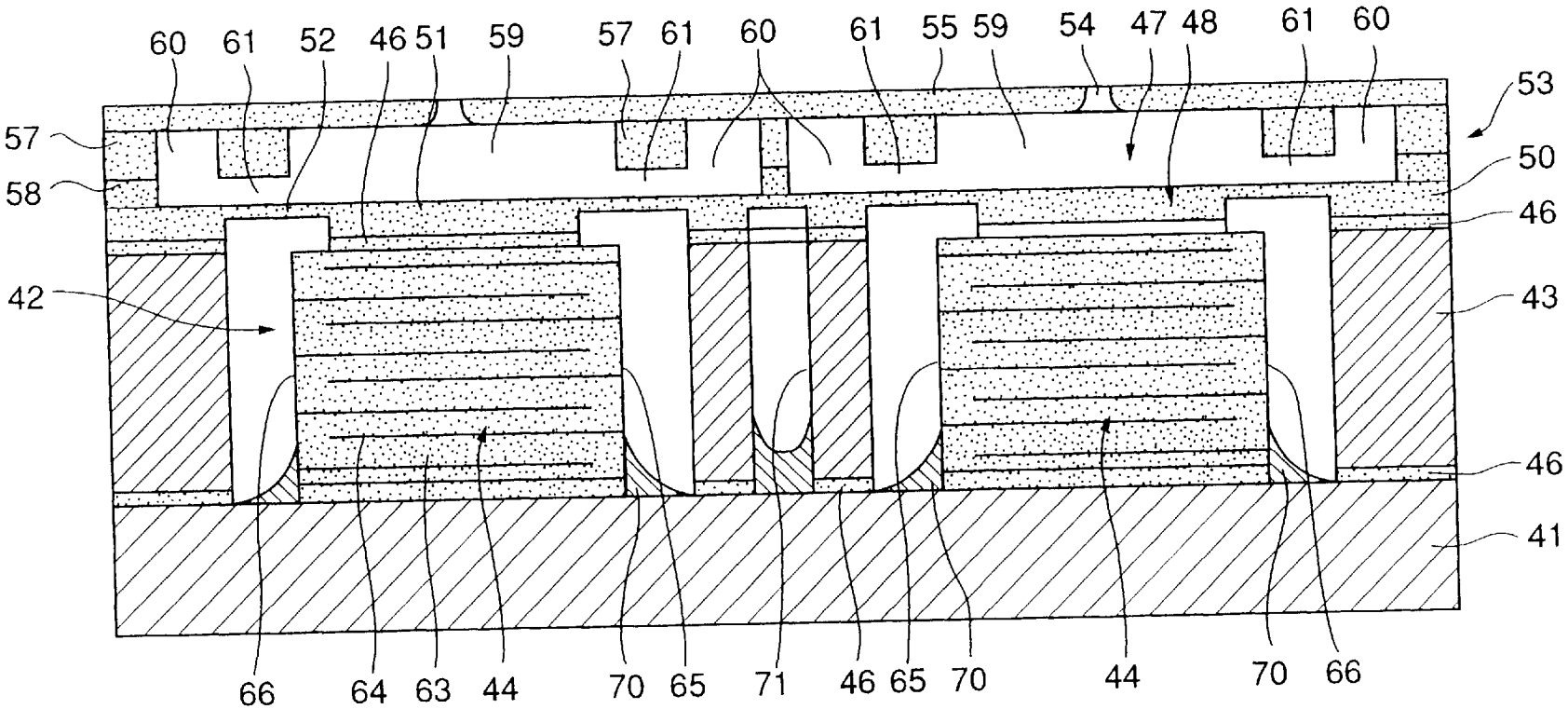
FIG. 4 is a diagram showing a cross-sectional view of the main portion of the ink-jet printing head shown in FIG. 3 in a magnified scale.
Figure 5:
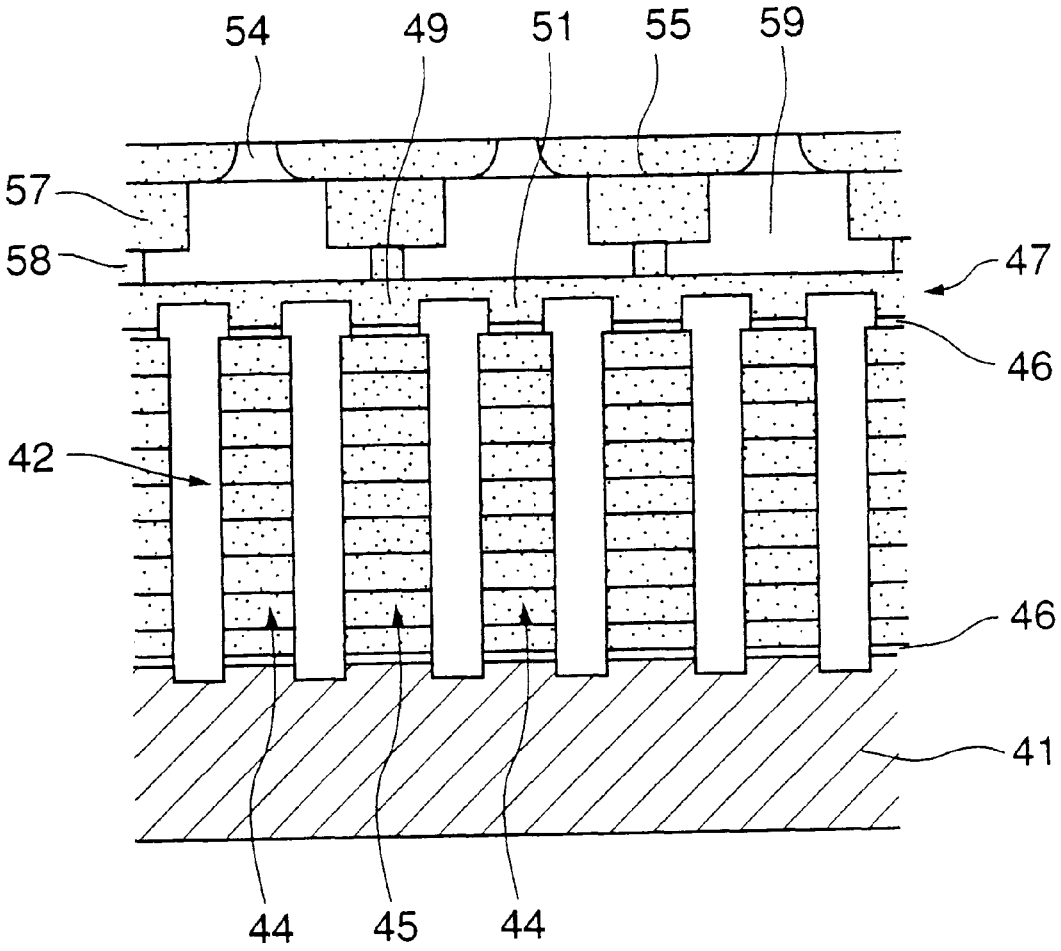
FIG. 5 is a diagram showing a cross-sectional view of the main portion of the ink-jet printing head shown in FIGS. 3 and 4 in a magnified scale from a different direction.

Next, examples of the ink-jet printing heads used in the recording head 5 will be described in detail with reference to FIGS. 3 through 5. FIG. 3 is a diagram showing an exploded perspective view of an ink-jet printing head, FIG. 4 is a diagram showing a cross-sectional view of the main portion of the ink-jet printing head in a magnified scale, and FIG. 5 is a diagram showing a cross-sectional view of the main portion of the ink-jet printing head in a magnified scale from a different direction.

The ink-jet printing head is comprised of a substrate 41, a laminated type piezoelectric element 42, a frame 43, actuating portions 44, non-actuating portions 45, an adhesive composition 46, an oscillating plate 47, a diaphragm 48, a beam 49, a base 50, a convex portion 51, a thin film portion 52, an ink chamber passage forming member 53, nozzles 54, a nozzle plate 55, an upper division wall 57, a lower division wall 58, ink chambers 59, common ink chambers 60, ink supplying passage 61, PZTs 63, inner electrodes 64, outer electrodes 65 and 66, common electrode patterns 67, single electrode patterns 68, conductive adhesive compositions 70, hole portions 71, FPC cables 72 and 73, and ink supplying holes 75, 76 and 77.

In the above ink-jet printing head, two laminated type piezoelectric elements 42 are attached to the substrate 41, which is comprised of an insulative material such as ceramics and glass epoxy resins, and the frame 43 is attached so as to surround each row of the laminated type piezoelectric elements 42. Here, the laminated type piezoelectric elements 42 have a structure in which the actuating portion 44, which is an actuator element, and the non-actuating portion, which supports the ink chamber members are provided alternately. Also, the upper surface of the laminated type piezoelectric element 42 and the upper surface of the frame 43 are processed so that their height becomes substantially equal and the surface flatness is maintained with high accuracy.

The oscillation plate 47 is attached to the upper surface of the laminated type piezoelectric element 42 and the upper surface of the frame 43. The oscillating plate 47 is comprised of the diaphragm 48 which is a displacement portion, the beam 49 which is attached to the non-actuating portion 45, and the base 50 which connects the frame 43. Also, the diaphragm 48 is comprised of the convex portion 51 and the thin film portion which is opposed to the actuating portion 44. Moreover, the substrate 41, the laminated type piezoelectric element 42 and the oscillating plate 47 are adhered by the adhesive composition 46 in this case.

The ink chamber passage forming member 53, which is comprised of such material as a two-layer photosensitive resin film, is adhered to the oscillating plate 47, and the nozzle plate 55, which is a nozzle forming member having a plurality of nozzles 54, is adhered to the ink chamber passage forming member 53. The ink chamber passage forming member 53 is comprised of the upper division wall 57 and the lower division wall 58, and forms, together with the oscillating plate 47 and the nozzle plate 55, the ink chamber 59 corresponding to the actuating portion 44, the common ink chambers 60 located on both sides of the ink chamber 59, and the ink supplying passage 61 which connects the ink chamber 59 and the common ink chamber 60 and function as a fluid resistance portion.

As shown in FIGS. 4 and 5, the laminated type piezoelectric element 42 is comprised of layers of PZT 63 (=$Pb(ZrTi)O_3$ in this case) having a thickness of about 20 to 50 $\mu$m/layer and layers of the inner electrode 64 which is comprised of AgPd having a thickness of a few $\mu$m/layer. Each layer is laminated alternately. By using the piezoelectric element of laminated type, each layer of which has a thickness of about 20 to 50 $\mu$m, it is possible to reduce the voltage necessary for its operation. For example, a field intensity of about 1000 V/mm may be obtained by a pulse voltage of 20 to 50 V. Note that the material which may be used for the piezoelectric element is not limited to $Pb(ZrTi)O_3$, and any known material used for a piezoelectric element such as $BaTiO_3$, $PbTiO_3$ and $(NaK)NbO_3$ may be suitable.

Each of the inner electrodes 64 of the laminated type piezoelectric element 42 is connected to the right and left outer electrodes 65 and 66. On the other hand, the common electrode pattern 67, which is located between each row of the laminated type piezoelectric elements 42 and applies driving voltage to the actuating portions 44, is formed on the substrate 41. Also, the single electrode patterns 68 which send selective signals to the actuating portions 44 is provided on the substrate 41. The outer electrode 65 of the actuating portion 44 is connected to the common electrode pattern 67 via the conductive adhesive 70 and the outer electrode 66 is connected to the single electrode pattern 68 via the conductive adhesive 70.

Each patterning portion is connected to the common electrode pattern 67 by applying the conductive adhesive 70 in the hole portion 71 formed in the central portion of the frame 43. Each of the common electrode pattern 67 and the single electrode pattern 68 is connected to the FPC cable 72 and 73, respectively. Also, the ink supplying holes 75, 76 and 77 for supplying ink from the outside to the common ink chamber 60 are formed in the substrate 41, the frame 43 and the oscillation plate 47, respectively.

Figure 6:
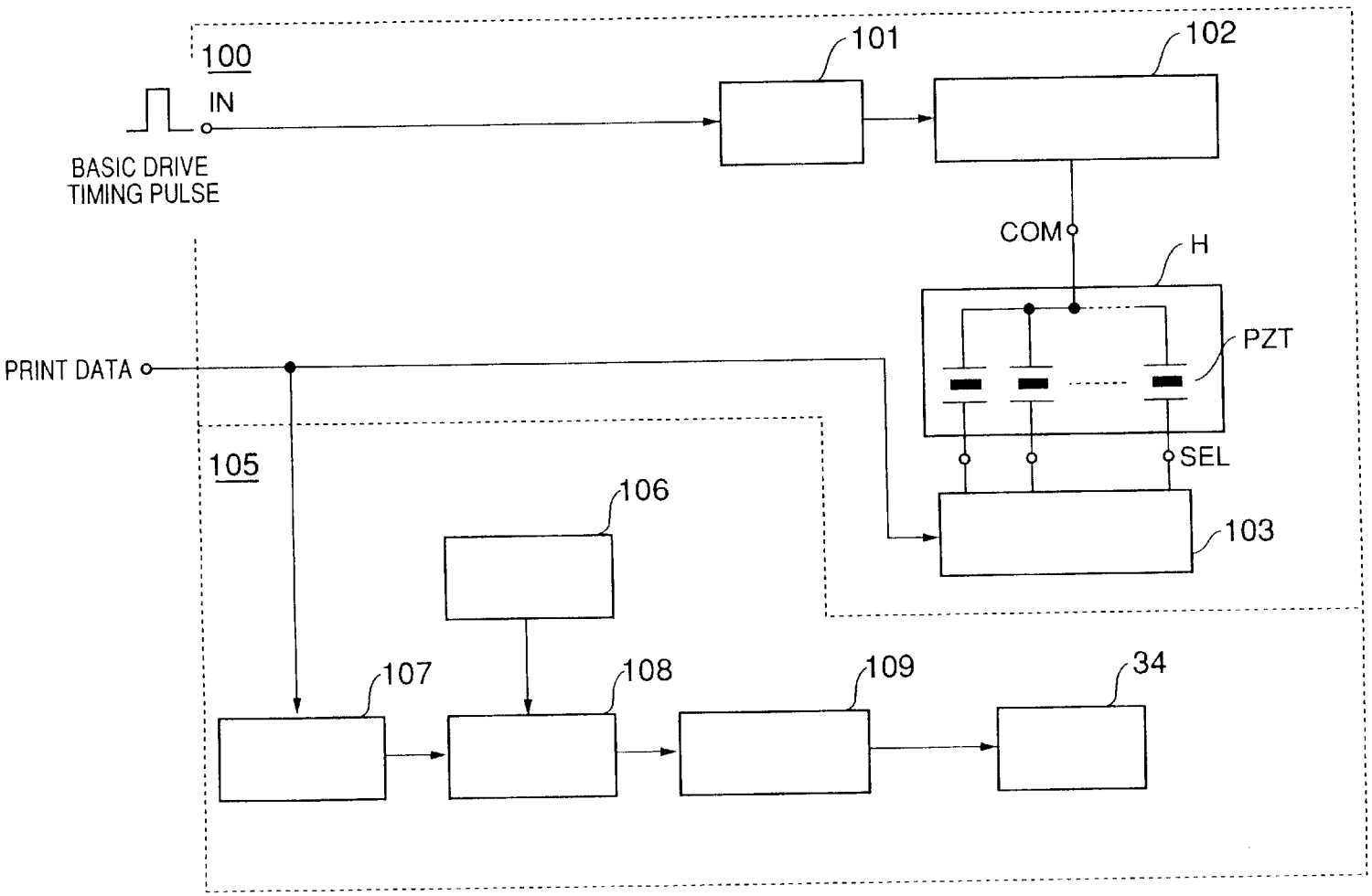
FIG. 6 is a block diagram for explaining a head driving circuit and a sub-scan driving control unit for an ink-jet printing device according to a first embodiment of the present invention.

Next, a printing head driving circuit and a sub-scan driving control unit for an ink-jet printing device according to a first embodiment of the present invention will be described with reference to FIG. 6. FIG. 6 is a block diagram for explaining the head driving circuit and the sub-scan driving control unit for an ink-jet printing device.

As shown in FIG. 6, a head driving circuit 100 according to the first embodiment of the present invention is comprised of a constant voltage driving circuit including a waveform generating circuit 101 and a low-impedance output circuit 102, and a channel selecting circuit 103.

The waveform generating circuit 101 generates a driving waveform of a waveform of predetermined voltage upon pressurizing the ink chamber according to a basic timing pulse, which is supplied to the common electrode "COM" connected to the common electrode pattern 67 of the ink-jet printing head "H". The low-impedance output circuit 102 supplies the output of the waveform generating circuit 101 to the common electrode "COM" of the ink-jet printing head "H". The channel selecting circuit 103 supplies selecting signals to a plurality of piezoelectric elements "PZT" (actuating portion 4) of the ink-jet printing head "H".

The waveform generating circuit 101 may be constructed using a ROM, a D/A converter or other pulse generating circuit and an integrating/differentiating circuit, and a wave-shaping circuit such as a clipping circuit and a clamping circuit. The low-impedance output circuit 102 may be comprised of a low-impedance amplifier having a buffer amplifier and SEPP (single ended push pull). By using the low-impedance output circuit, the output of the driving voltage waveform becomes a low impedance to the piezoelectric elements and the waveform is not strained by the distribution of the piezoelectric elements and the number of driving channels.

Also, the channel selecting circuit 103 may be comprised of a shift register circuit, latch circuit, and a transistor and a diode array correspond to each of the piezoelectric elements "PZT" channel, (the term "channel" in this specification means a portion formed by a nozzle, an ink chamber and a piezoelectric element) of the ink-jet printing head "H".

On the other hand, as shown in FIG. 6, a sub-scan driving control unit 105 is comprised of a scanning number counter 106, a printing data retrieving circuit 107, a motor drive control circuit 108, and a sub-scanning motor driving circuit 109.

The scanning number counter 106 counts the number of scans and the printing data retrieving circuit 107 retrieves the printing data of a nozzle located at an end of the opposite direction of the sub-scanning direction. The motor drive control circuit 108 controls a line feeding operation when the counted value of the scanning number counter 106 becomes "n" and the printing data retrieving circuit 107 retrieves no printing data. The sub-scanning motor driving circuit 109 controls the rotation of the sub-scanning motor 34 in accordance with the driving signals from the motor drive control circuit 108. The sub-scan driving control unit 105 forms a means to scan the recording head 5 for several times by not carrying out a sub-scanning (i.e., line feeding).

Now, an embodiment of the constant voltage driving circuit of the ink-jet printing head driving circuit will be explained with reference to FIG. 7.

Figure 7:
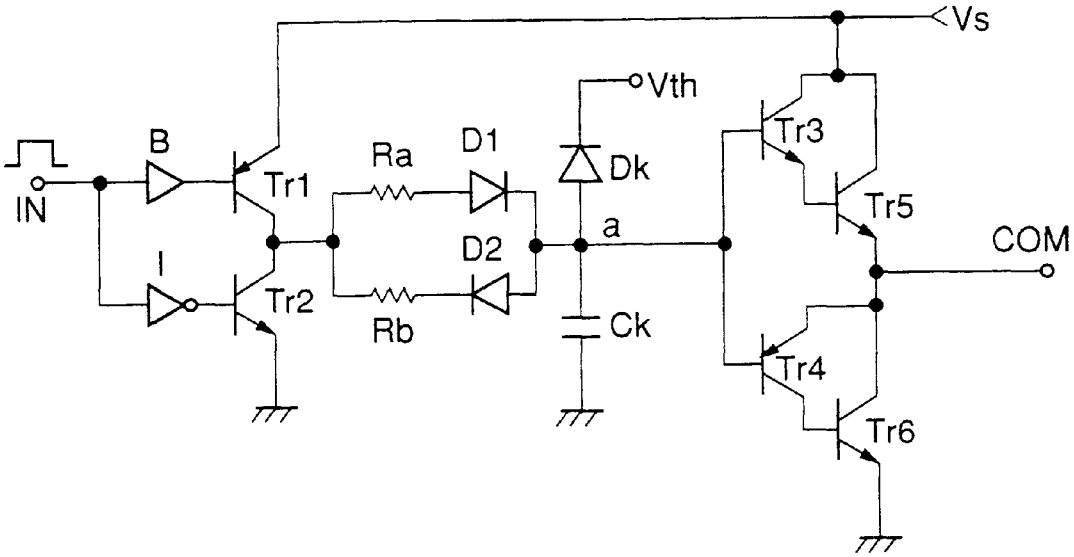
FIG. 7 is a diagram showing a constant voltage driving circuit according to a first embodiment of the present invention.

In the constant voltage driving circuit shown in FIG. 7, an input terminal "IN", from which a basic drive timing pulse is supplied, is connected to a base of a transistor "Tr1" via a buffer "B", and is connected to a base of a transistor "Tr2" via an inverter "I". A certain voltage "Vs" is supplied to a collector of the transistor "Tr1" and an emitter of the transistor "Tr2" is grounded.

The emitter of the transistor "Tr1" and the collector of the transistor "Tr2" are connected to a parallel circuit comprising a series circuit of a resistance "ra" and a diode "D1" and a series circuit of a resistance "rb" and a diode "D2". The diodes D1 and D2 are connected at a point "a" and a condenser "Ck" is connected between the point "a" and the ground. Thus, a time constant circuit for charging is formed by the resistance ra and the condenser Ck, and a time constant circuit for discharging is formed by the resistance rb and the condenser Ck. Also, a voltage "Vth" is applied to the point "a" via a diode "Dk".

The point "a" is also connected to a point between a base of a transistor "Tr3" and a base of a transistor "Tr4", which are located on the input side of the low-impedance output circuit 24 comprising transistors "Tr3" to "Tr6". on the other hand, a point between an emitter of the transistor "Tr5" and a collector of the transistor "Tr6" is connected to the common electrode "COM" of the ink-jet printing head "H".

In this constant voltage driving circuit, the buffer B outputs a voltage whose level is lower than the voltage Vs so that the transistor Tr1 is turned on when the basic drive timing pulse is input to the input terminal "IN". Thus, the output of the inverter "I" enters the state "L" and the transistor Tr2 is turned off so that a charging of the condenser Ck is started at a time constant determined by the resistance ra and the condenser Ck depending on the voltage Vs. At this time, since the voltage Vth is supplied to the point "a" via the diode Dk (decent voltage Vd), the charging voltage of the condenser Ck is clipped to the voltage Vp. That is, the charging is performed until Vp=Vth+Vd and this voltage is the maximum value for the driving voltage Vp.

Also, when the input of the basic drive timing pulse to the input terminal "IN" is stopped, the output of the buffer B becomes the voltage Vs and the transistor Tr1 is turned off. Thus, the output of the inverter "I" enters the state "H" and the transistor Tr2 is turned on so that a discharging of the condenser Ck, which has been charged to the voltage Vp by a time constant determined by the resistance ra and the condenser Ck, is started.

Figure 8:
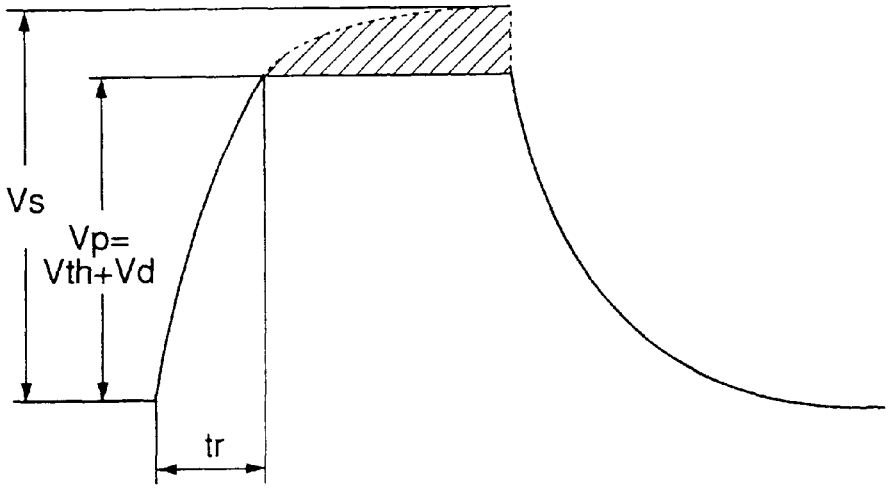
FIG. 8 is a diagram for explaining a driving waveform which may be output from the constant voltage driving circuit shown in FIG. 7.

Therefore, since the above-mentioned driving voltage Vp is supplied to the common electrode "COM" of the recording head 5 from the low-impedance output circuit 102, a driving waveform such as shown in FIG. 8 generated by the waveform generating circuit 101 is supplied to the piezoelectric elements PZT which are selected by the channel selecting circuit 103 so that the piezoelectric elements are actuated accordingly.

Next, a manner of making various color tone prints using the above-mentioned ink-jet printing device will be explained with reference to FIGS. 9 through 14. Here, for simplicity, it is assumed that only one ink-jet printing head "H" having eight nozzles is used in the recording head 5.

Figure 9:
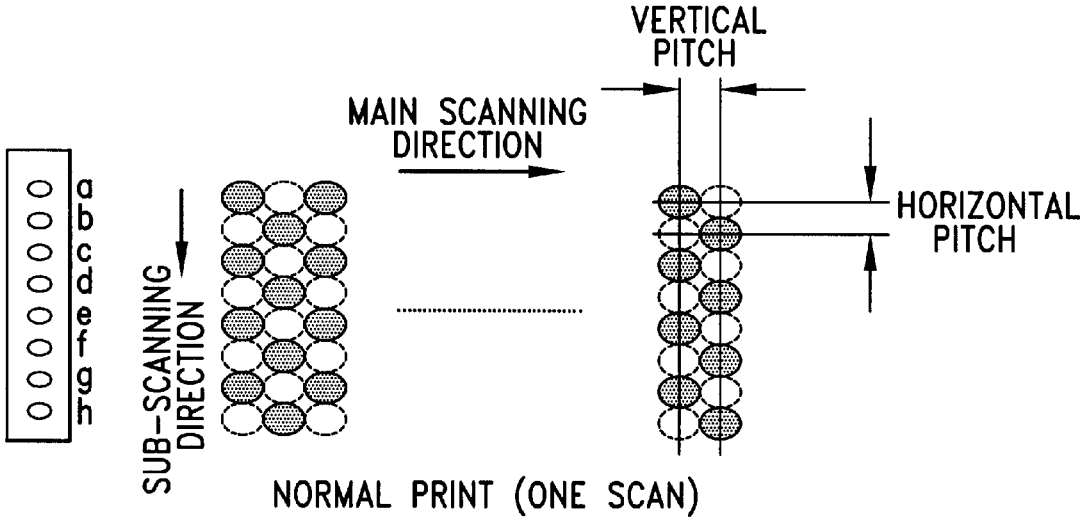
FIG. 9 is a diagram for explaining a pattern of discharged ink drops in one scan.
Figure 10A:
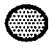
FIG. 10A is a diagram for explaining a dot size produced by one scan.
Figure 10B:
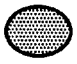
FIG. 10B is a diagram for explaining a dot size produced by two scans.
Figure 10C:
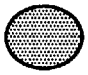
FIG. 10C is a diagram for explaining a dot size produced by three scans.

FIG. 9 is a diagram for explaining a case in which an ink drop is ejected from the nozzles a, c, e and g, then from the nozzles b, d, f and h, and then from the nozzles a, c, e and g again while the printing head "H" makes one scan in a main scanning direction (i.e., the alignment direction of the nozzles is a sub-scanning direction).

If the printing head "H" scans in the main scanning direction a certain number of times without performing the line feeding in the sub-scanning direction, the size of each dot formed on a recording medium is increased according to the number of ink drops applied to the spot. For instance, a first ink drop may form a dot of a size shown in FIG. 10A, then if a second ink drop is applied onto the dot formed by the first ink drop, it may form a dot of a size shown in FIG. 10B. If a third ink drop is applied onto the dot formed by the second ink drop, it may form a dot of a size shown in FIG. 10C. Accordingly, it is possible to achieve four levels of dot size in this case (including a level in which no ink drops are applied).

Figure 11:
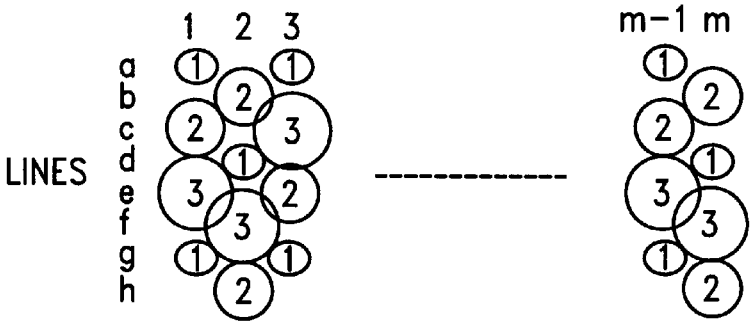
FIG. 11 is a diagram for explaining a pattern of discharged ink drops according to the first embodiment of the present invention.
Figure 12:
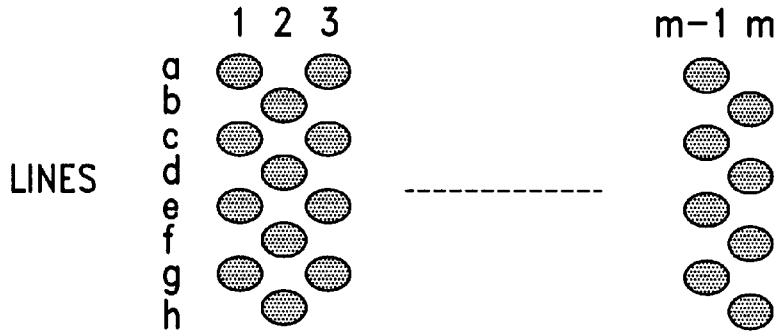
FIG. 12 is a diagram for explaining a process of forming a pattern of discharged ink drops according to the first embodiment of the present invention.
Figure 13:
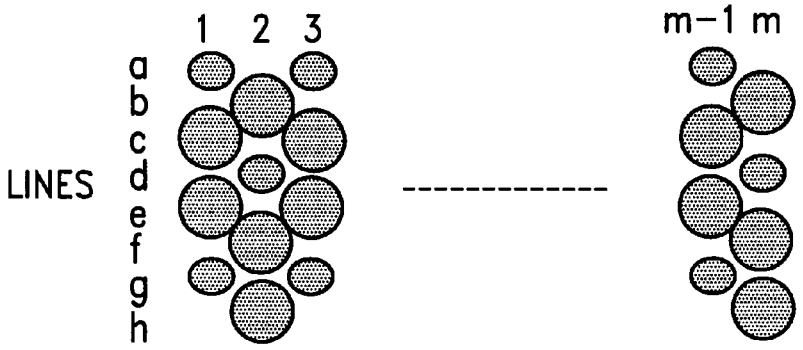
FIG. 13 is a diagram for explaining a process of forming a pattern of discharged ink drops according to the first embodiment of the present invention.
Figure 14:
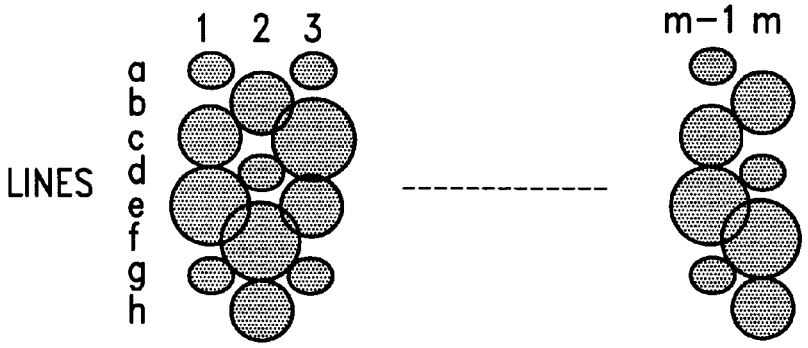
FIG. 14 is a diagram for explaining a process of forming a pattern of discharged ink drops according to the first embodiment of the present invention.

When an image shown in FIG. 11A is recorded, an ink drop is applied to a center portion of each circle indicated by the numerals 1, 2 and 3 at a first scan to form a printing pattern as shown in FIG. 12A, and then a second ink drop is applied to a center portion of each circle indicated by the numerals 2 and 3 at a second scan to form a printing pattern as shown in FIG. 13A. Likewise, a third ink drop is applied to a center portion of each circle indicated by the numeral 3 at a third scan to form a printing pattern as shown in FIG. 14A. It is possible to reduce the time necessary for printing if the sizes of each dot in the same row are all the same. For example, the size of each dot in the line "a" shown in FIG. 11 is the same (i.e., one ink drop is applied to two points), a line may be fed by one row after finishing the first scan.

In order to achieve the formation of the above-mentioned image, printing data, by which the piezoelectric elements "PZT" are actuated, are given to the channel selecting circuit 103 of the head driving circuit 100 shown in FIG. 6. For instance, when the image shown in FIG. 11A is formed, first printing data by which the PZT correspond to the circles 1, 2 and 3 are actuated, second printing data by which the PZT correspond to the circles 2 and 3 are actuated, and third printing data by which the PZT correspond to the circles are actuated, are supplied to the channel selecting circuit 103 at the first, the second and the third scanning, respectively.

On the other hand, the scanning number counter 106 of the sub-scan driving control unit 105 increases the count value by one from 1 to n (here n=3) for every scan performed. When the count value reaches n, the motor drive control circuit 108 controls the sub-scanning motor driving circuit 109 and drives the sub-scanning motor 34 so that the paper 24 is fed for a predetermined line number. Also, the printing data retrieving circuit 107 retrieves a nozzle of the ink-jet printing head "H" located at the end in the opposing direction of the sub-scanning direction, that is, a nozzle which forms a top dot (eg., nozzle "a" shown in FIG. 9), and if there is no printing data, that information is transmitted to the motor drive control circuit 108 and it performs a line feeding as explained above.

Thus, according to the present invention, it is possible to obtain an image of various color tones by forming dots of different sizes on a recording medium by carrying out a certain number of scans of a recording head.

Next, a printing head driving circuit and a sub-scan driving control unit according to a second embodiment of the present invention will be described in detail with reference to FIG. 15.

According to this embodiment, the landing or deposition position of an ink drop for a pixel in at least one scan operation among a plurality of scan operations is made to be different from the landing or deposition position of an ink drop for the pixel in the other scan operations within a pitch between two vertical lines of pixel. In this case, a drive timing adjusting circuit 110 for delaying a basic timing pulse according to a counted value of the scan number counter 106 is provided, and when a counted value of the scan number counter 106 of the above-mentioned first embodiment is input, a basic timing pulse which is delayed by the drive timing adjusting circuit 110 is supplied to the waveform generating circuit 101.

FIGS. 16 through 19 are diagrams for explaining the function of the above-mentioned second embodiment of the present invention.

Figure 16A:
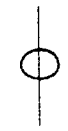
FIG. 16A is a diagram for explaining a shift of a landing or deposition position of an ink drop during three scans according to the second embodiment of the present invention.
Figure 16B:
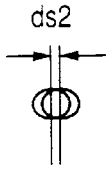
FIG. 16B is a diagram for explaining a shift of a landing or deposition position of an ink drop during three scans according to the second embodiment of the present invention.
Figure 16C:
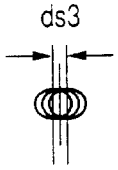
FIG. 16C is a diagram for explaining a shift of a landing or deposition position of an ink drop during three scans according to the second embodiment of the present invention.

First, as shown in FIG. 16A, a drop of ink is applied onto a recording medium at a first scan. The central axis of the ink drop is also shown in FIG. 16A. Then, a second drop of ink is applied to the recording medium as shown in FIG. 16B. At this time, the central axis of the second ink drop is shifted from that of the first ink drop in the main scanning direction by "ds2" shown in the figure. Likewise, when a third ink drop is applied to the recording medium, its central axis is shifted from the central axis of the first ink drop in the main scanning direction by "ds3" as shown in FIG. 16C. In this manner, only some portion of an ink drop may be superimposed with the other ink drops and ink dots which are different from those in the first embodiment in terms of optical density and dot size may be produced. Also, it is possible to merge a dot with another dot by applying each ink drop without providing a sufficient time interval between each dot, or to prevent merging of dots by applying each ink drop in a certain time interval.

Figure 17:
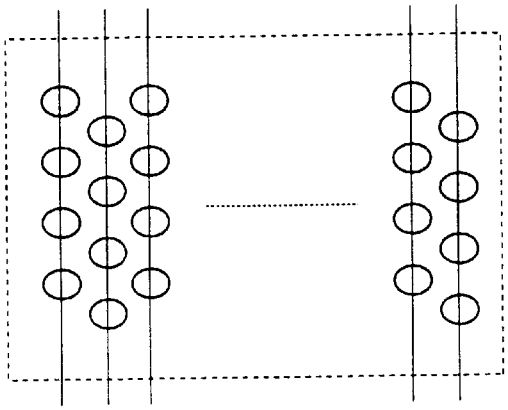
FIG. 17 is a diagram for explaining a formation process of a printed pattern according to the second embodiment of the present invention.
Figure 18:
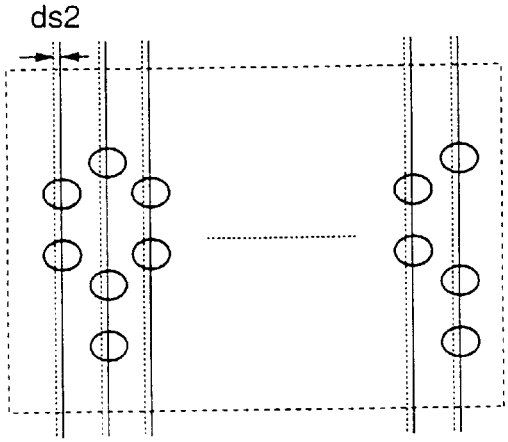
FIG. 18 is a diagram for explaining a formation process of a printed pattern according to the second embodiment of the present invention.

When an image as shown in FIG. 11, for example, is printed in this embodiment, a printing pattern as shown in FIG. 17 is printed on a recording medium during a first scanning. Then, a second printing pattern as shown in FIG. 18 is printed on the recording medium during a second scanning. At this time, the deposition position of each ink drop is shifted by "ds2" in the main scanning direction as shown in the figure. Likewise, a third printing pattern as shown in FIG. 19 is printed on the recording medium during a third scanning by shifting the deposition position of each ink drop by "ds3" in the main scanning direction as shown in FIG. 19. In this manner, a desirable image may be obtained.

Note that in the above embodiment the landing or deposition position of a second ink drop is not necessarily shifted by "ds2" and may be shifted by "ds3" so that a dot may be formed by one or two ink drops depending on the type of ink or recording medium used.

Figure 15:
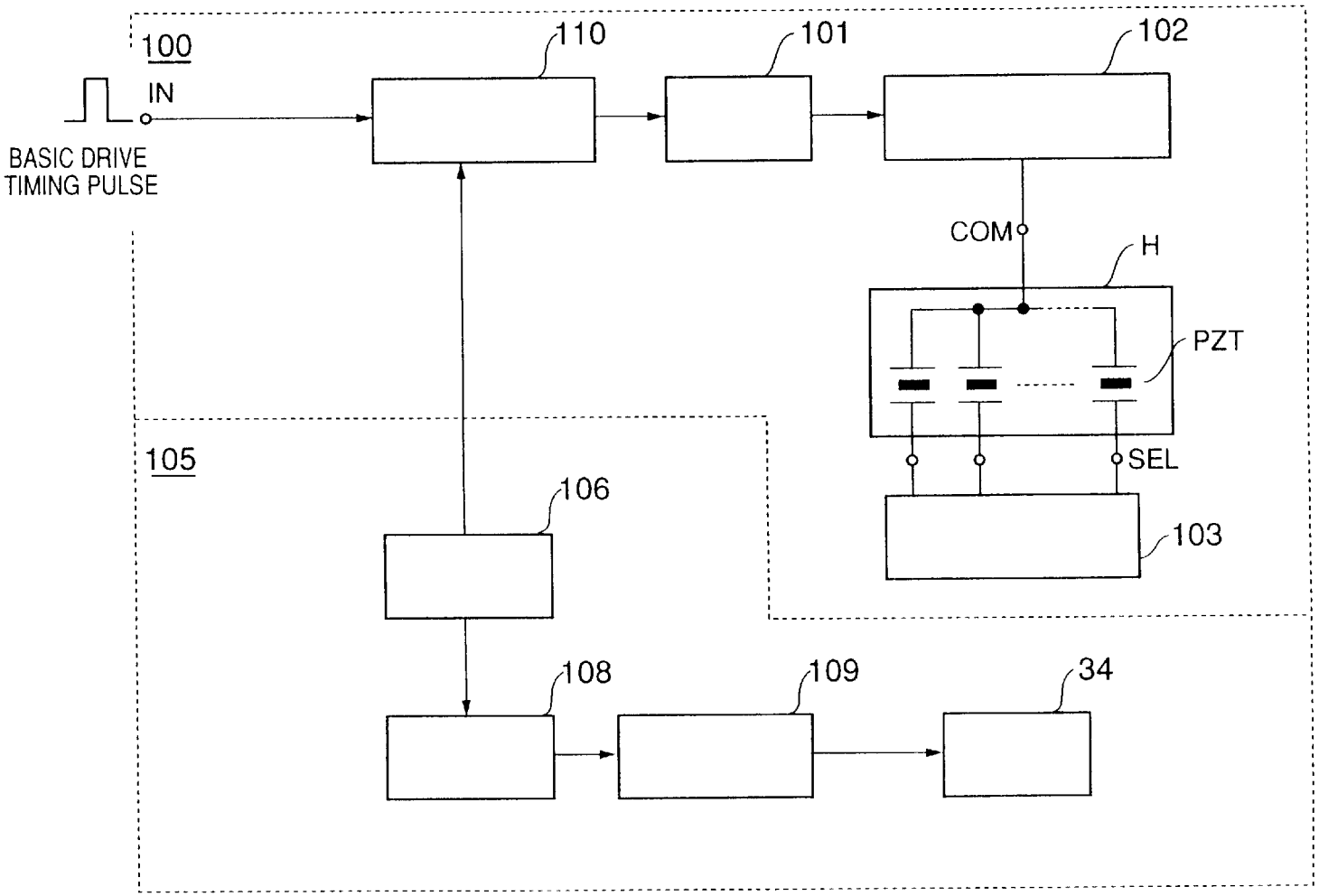
FIG. 15 is a block diagram showing a head driving circuit and a sub-scan driving control circuit according to a second embodiment of the present invention.

In order to obtain an image having the above-mentioned color tone, the scanning number counter 106 of the sub-scan driving control unit 105 shown in FIG. 15 increases the count value by one from 1 to n (here n=3) for each scanning operation. When the count value reaches n, the motor drive control circuit 108 controls the sub-scanning motor driving circuit 109 and drives the sub-scanning motor 34 so that the paper 24 is fed for a predetermined line number (8 dots in the above case).

On the other hand, the drive timing adjusting circuit 110 of the head driving circuit 100 outputs an input basic drive timing pulse with a delaying time of "0" when the counted value of the scanning number counter 106 is "1" as shown in FIG. 20A. Also, the drive timing adjusting circuit 110 outputs an input basic drive timing pulse with a delaying time of "t2" when the counted value of the scanning number counter 106 is "2" as shown in FIG. 20B. Likewise, the drive timing adjusting circuit 110 outputs an input basic drive timing pulse with a delaying time of "t3" when the counted value of the scanning number counter 106 is "3" as shown in FIG. 20C.

In the above case, since the ejection timing of ink drops from nozzles of a recording head is synchronized with a rising-time of each driving waveform, the shift "ds2" of the deposition position of a second ink drop at the second scanning from the deposition position of a first ink drop may be expressed as:

$$ds2=Vc\times t2$$

(where Vc is a velocity of a carriage)

Likewise, the shift "ds3" of the deposition position of a third ink drop at the third scanning from the deposition position of a first ink drop may be expressed as:

$$ds3=Vc\times t3$$

Therefore, it is possible to obtain a desirable shift of ink drops by setting a delaying time t by which the shift of ink drops at each scan may be attained beforehand.

The maximal length of the shift "ds" of ink drops may be a pitch between two vertical lines of a pixel. In general, however, it is preferable to set the relationship between the scanning number "m" and the amount of shift "ds" as follows:

$$ds\ (m)\leqq(pitch)\times\tfrac{1}{2},\ ds\ (m-1)\leqq ds\ (m),\ m\geqq 2$$

As mentioned above, according to the present invention, it is possible to obtain an image of various color tones formed by dots of different optical density and sizes by making the deposition position of an ink drop for a pixel in at least one scan of a plurality of scans different from the deposition position of an ink drop for the pixel in the other scans.

Also, since the deposition position of an ink drop is made different from that of another ink drop by using a different drive timing in at least one scan of a plurality of scans from the drive timing of the other scans within a pitch of two vertical lines of pixels, it is possible to form multi-level dots with a simple control of a printing head driving circuit and without changing a drive timing during a main scan. Thus, a high grade image may be obtained at a low cost.

Next, a printing head driving circuit and a sub-scan driving control unit according to a third embodiment of the present invention will be described in detail with reference to FIG. 21.

According to this embodiment, the deposition position of an ink drop for a pixel in at least one scan operation of a plurality of scan operations is different from the deposition position of an ink drop for the pixel in the other scan operations within a pitch between two horizontal lines of a pixel. In this case, the motor driving control circuit 108 in the above first embodiment determines a shift in the sub-scanning direction according to a counted value input from the scanning number counter 106. A motor rotation step number information generation circuit 111 determines the number of rotation steps of the sub-scanning motor 34 from the shift in the sub-scanning direction determined by the motor driving control circuit 108. The sub-scanning motor driving circuit 109 drives the sub-scan motor 34 by the number of rotation steps based on the information from the motor rotation step number information generation circuit 111.

Figures 22A, 22B, 22C:
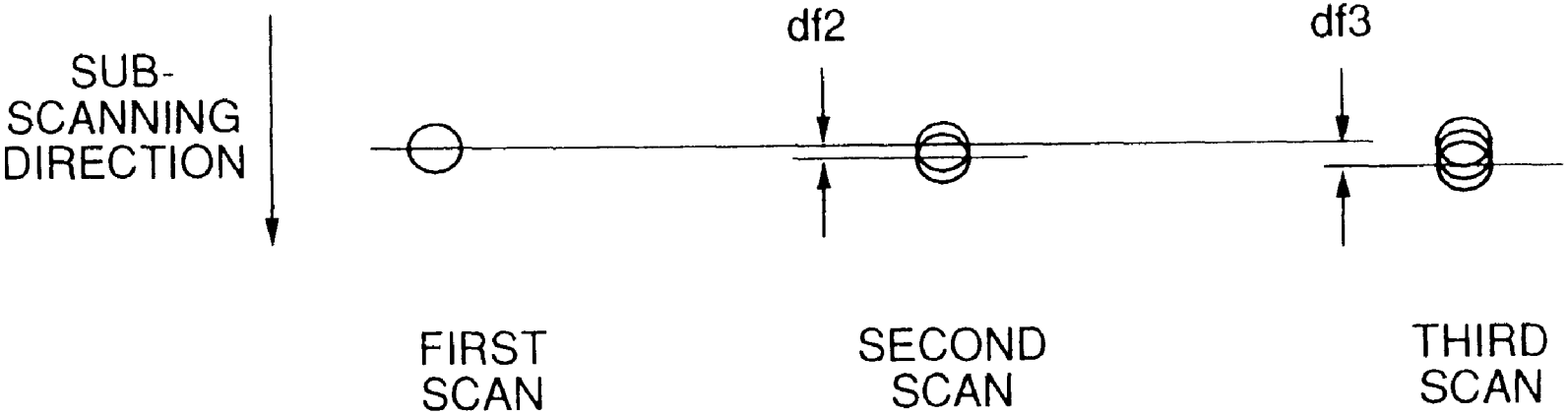
FIG. 22A is a diagram for explaining a shift of a landing or deposition position of an ink drop during three scans according to the third embodiment of the present invention.
FIG. 22B is a diagram for explaining a shift of a landing or deposition position of an ink drop during three scans according to the third embodiment of the present invention.
FIG. 22C is a diagram for explaining a shift of a landing or deposition position of an ink drop during three scans according to the third embodiment of the present invention.

The function of this embodiment according to the present invention will be described with reference to FIGS. 22A through 22C. As shown in FIG. 22A, a drop of ink is applied to a recording medium at a first scan. The central axis of the ink drop in a horizontal direction is also shown in FIG. 22A. Then, a second drop of ink is applied to the recording medium as shown in FIG. 22B. At this time, the central axis of the second ink drop is shifted from that of the first ink drop in the sub-scanning direction by "df2" shown in the figure. Likewise, when a third ink drop is applied to the recording medium, its central axis is shifted from the central axis of the first ink drop in the sub-scanning direction by "df3" as shown in FIG. 22C. In this manner, only some portion of an ink drop may be superimposed with the other ink drops and ink dots which are different from those in the first embodiment and the second embodiment in terms of optical density may be produced and four levels of dot sizes may also be produced. Moreover, as mentioned above, it is possible to merge a dot with another dot by applying each ink drop by not providing sufficient drying time intervals, or to prevent merging of dots by applying each ink drop at a certain time interval which provides sufficient drying time.

When an image as shown in FIG. 11, for example, is printed in this embodiment, a printing pattern indicated by circles having the numerals 1, 2 and 3 is printed on a recording medium at a first scanning. Then, a second printing indicated by circles having the numerals 2 and 3 is printed on the recording medium at a second scanning. At this time, the deposition position of each ink drop is shifted by "df2" in the sub-scanning direction as indicated by FIG. 22B. Likewise, a third printing pattern indicated by circles having the numeral 3 is printed on the recording medium at a third scanning by shifting the deposition position of each ink drop by "df3" in the sub-scanning direction as indicated by FIG. 22C. In this manner, a desirable image may be obtained.

Note that in the above embodiment the deposition position of a second ink drop is not necessarily shifted by "df2" and may be shifted by "df3" so that a dot may be formed by one or two ink drops depending on the type of ink or recording medium used.

Figure 21:
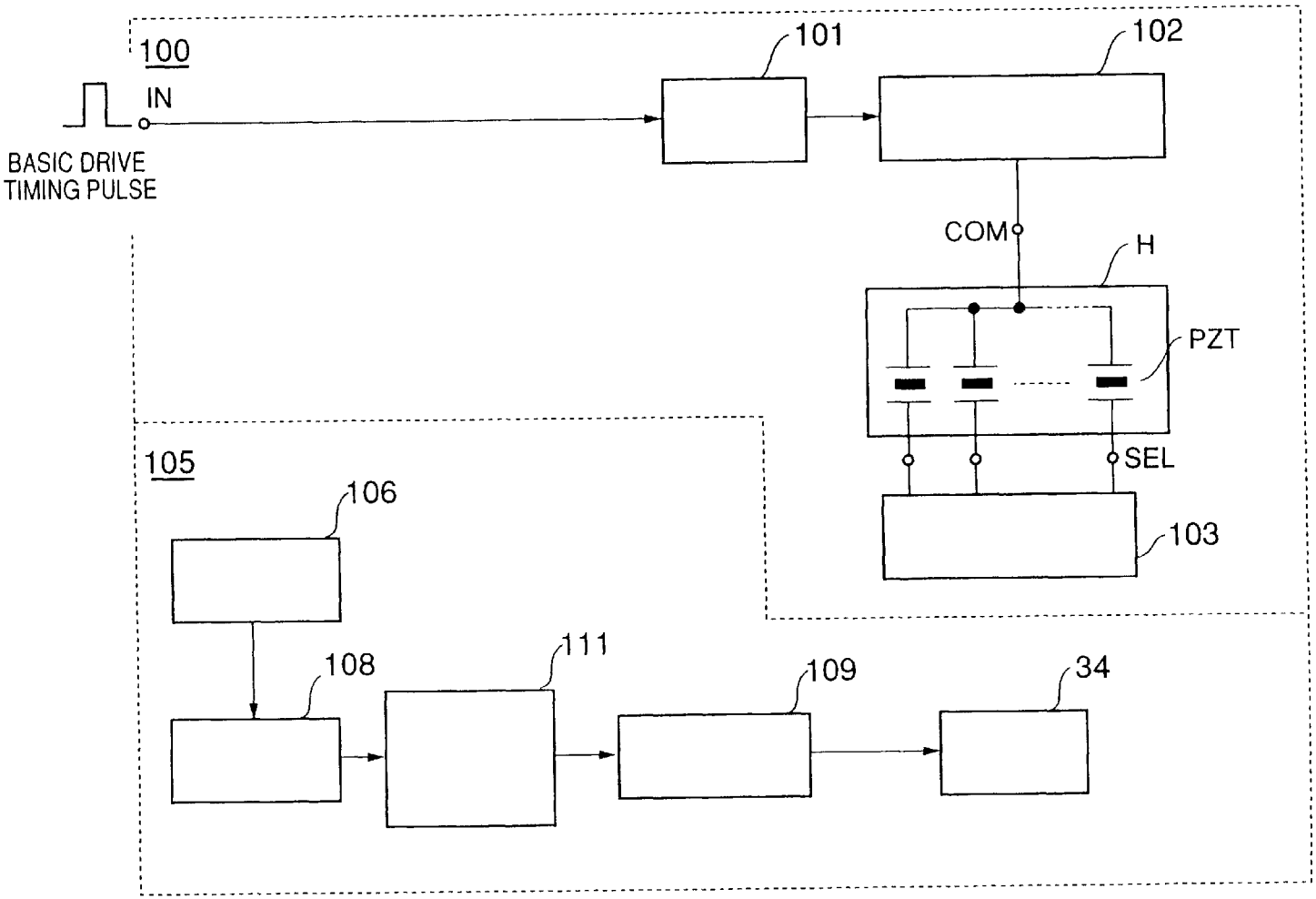
FIG. 21 is a block diagram showing a head driving circuit and a sub-scan driving control circuit according to a third embodiment of the present invention.

In order to obtain an image having the above-mentioned levels of color tone, the scanning number counter 106 of the sub-scan driving control unit 105 shown in FIG. 21 increases the count value by one from 1 to n (here n=3) for every scan performed. The motor drive control circuit 108 determines that the shift df is "0" when the counted value of the scanning number counter 106 is "1", the shift df is "df2" when the counted value is "2", and the shift df is "df3" when the counted value of the scanning number counter 106 is "3". Then, rotation step number information according to the shift df is output from the motor rotation step number information generating circuit 111 at each scanning so that the paper 24 is fed by the shift df by the rotation of the sub-scan motor 34 corresponding to the rotation step number information.

The maximal length of the shift "df" of ink drops may be a pitch between two horizontal lines of a pixel. In general, however, it is preferable to set the relationship between the number of scanning "m" and the "df" as follows:

$$df\,(m) \leqq (pitch) \times ½,\ df\,(m-1) \leqq df\,(m),\ m \geqq 2$$

As mentioned above, according to the present invention, it is possible to obtain an image of various color tones formed by dots of different optical density and sizes by making the deposition position of an ink drop for a pixel in at least one scan of a plurality of scans is different from the deposition position of an ink drop for the pixel in the other scans.

Also, since the deposition position of an ink drop is caused to be different from that of another ink drop by causing the amount of paper feeding in at least one scan of a plurality of scans to be different from the amount of paper feeding of the other scans within a pitch of two horizontal lines of pixels, it is possible to form multi-level dots with a simple control of a sub-scan driving control unit without changing the amount of paper feeding during a main scan. Thus, a high grade image may be obtained at a low cost.

Next, a printing head driving circuit and a sub-scan driving control unit according to a fourth embodiment of the present invention will be described in detail with reference to FIG. 23.

According to this embodiment, a volume of discharged ink for a pixel in at least one scan operation from among a plurality of scan operations is made to be different from a volume of discharged ink for the pixel in the other scan operations. In the fourth embodiment according to the present invention, a driving voltage adjusting circuit 112 which changes a driving voltage Vp having a driving waveform generated by the waveform generating circuit 101 according to a counted value of the scanning number counter 106 is provided.

Figure 24A:
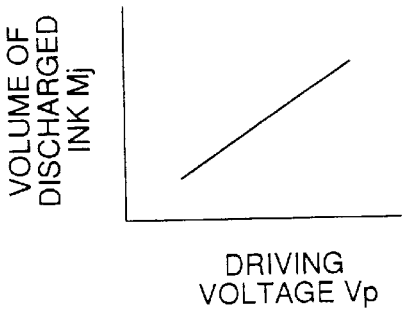
FIG. 24A is a graph for explaining the relationship between the volume of discharged ink and the driving voltage.
Figure 24B:
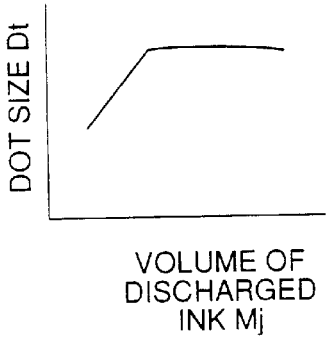
FIG. 24B is a graph for explaining the relationship between the dot size and the volume of discharged ink.

FIGS. 24 and 25 are diagrams for explaining the function of this embodiment. In general, the volume of discharged ink Mj is increased in proportion to the increase of the driving voltage Vp as shown in FIG. 24A and a dot size formed on a recording medium is changed in accordance with an increase of the volume of discharged ink Mj as shown in FIG. 24B. Therefore, it is possible to change a dot size formed on a recording medium by varying the driving voltage Vp.

As explained above in FIG. 7, the driving voltage Vp in the waveform generating circuit 101 of the printing head driving circuit 100 may be expressed as: Vp=Vth+Vd. Therefore, the driving voltage Vp may be varied by changing the clipping voltage Vth. Also, when a circuit which generates a voltage Vh from a voltage Vs is used, the driving voltage Vp may be changed by varying the voltage Vs.

Figure 23:
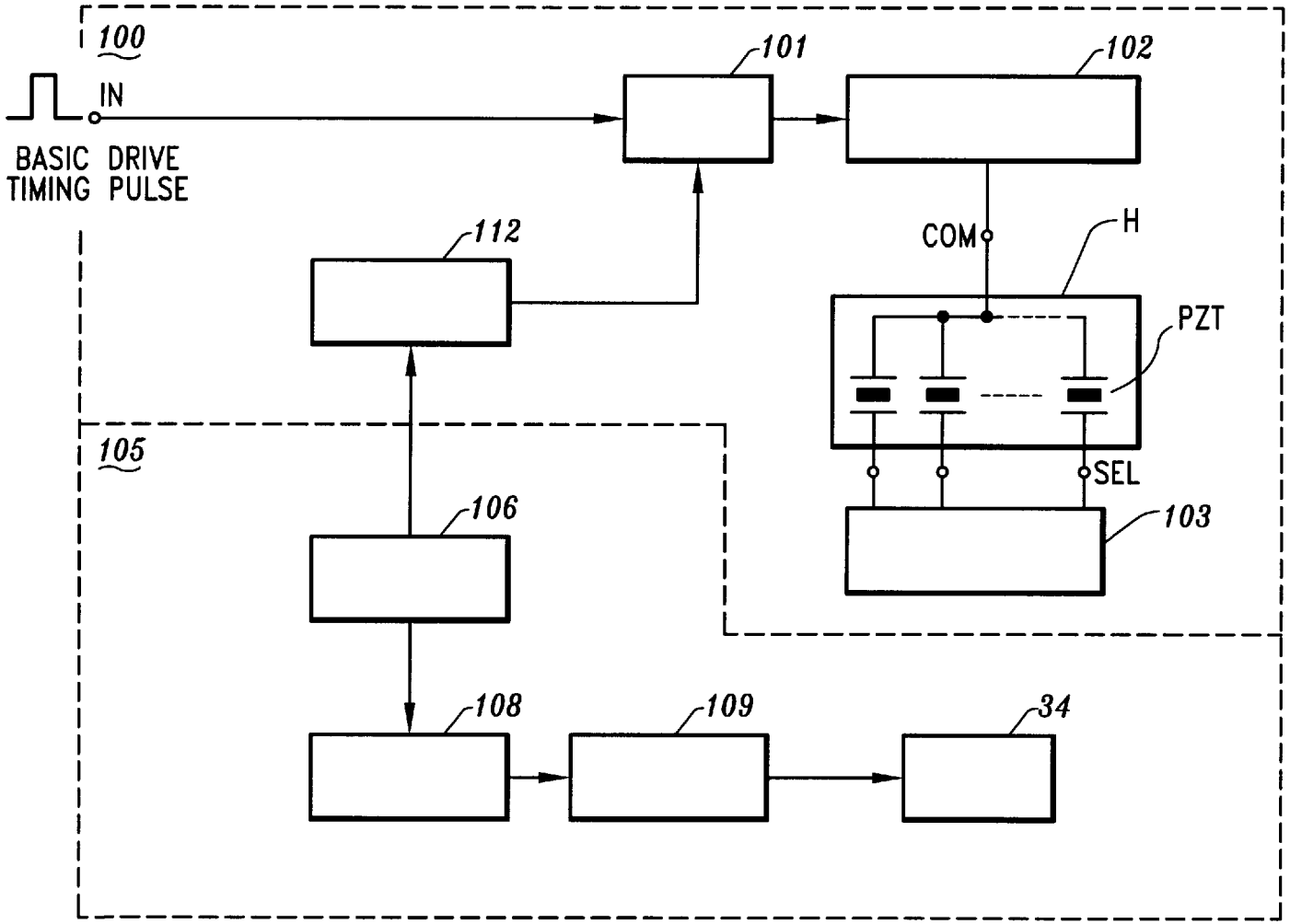
FIG. 23 is a block diagram showing a head driving circuit and a sub-scan driving control circuit according to a fourth embodiment of the present invention.
Figure 25A:
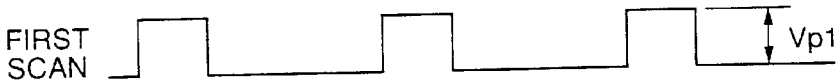
FIG. 25A is a diagram for explaining a driving waveform which is output from the head driving circuit according to the fourth embodiment of the present invention.
Figure 25B:
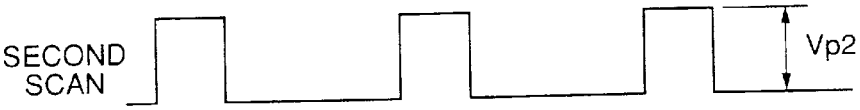
FIG. 25B is a diagram for explaining a driving waveform which is output from the head driving circuit according to the fourth embodiment of the present invention.
Figure 25C:
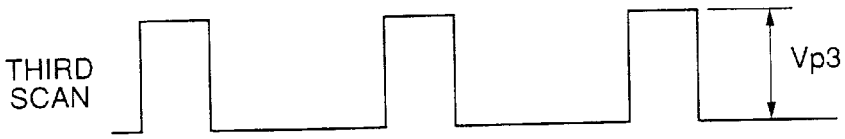
FIG. 25C is a diagram for explaining a driving waveform which is output from the head driving circuit according to the fourth embodiment of the present invention.

The driving voltage adjusting circuit 112 of the printing head driving circuit 100 shown in FIG. 23 supplies a voltage Vth, by which a driving voltage Vp1 may be obtained as shown in FIG. 25A, to the waveform generating circuit 101 when a counted value of the scanning number counter 106 is "1". Also, the driving voltage adjusting circuit 112 supplies a voltage Vth, by which a driving voltage Vp2 may be obtained as shown in FIG. 25B, to the waveform generating circuit 101 when a counted value of the scanning number counter 106 is "2". Likewise, the driving voltage adjusting circuit 112 supplies a voltage Vth, by which a driving voltage Vp3 may be obtained as shown in FIG. 25C, to the waveform generating circuit 101 when a counted value of the scanning number counter 106 is "3".

In this manner, the piezoelectric elements PZT are actuated by the driving voltage Vp1 during the first scanning, and actuated by the driving voltage Vp2 and Vp3 during the second scanning and the third scanning, respectively. Thus, the volume of discharged ink Mj may be changed at each scanning.

When the volume of discharged ink, Mj, is controlled by three different driving voltages, it is possible to produce four different levels of dots (i.e., zero, first, second and third level) during three scanning operations if no ink drops are superimposed. Also, if some ink drops are superimposed once on a recording medium during the three scanning operations, it is possible to achieve seven different levels of dots. Moreover, if some ink drops are superimposed once or twice on a recording medium during the three scanning operations, it is possible to achieve eight different levels of dots.

As mentioned above, according to this embodiment, it is possible to obtain an image of multi-level color tone, which has an optical density different from that of an image produced by simple superimposing of ink drops by making a volume of discharged ink for a pixel in at least one scan operation of a plurality of scan operations different from a volume of discharged ink for the pixel in the other scan operations. Thus, a higher grade image may be obtained according to this embodiment.

Also, since the driving waveform of at least one scan is made to be different from that of the other scans, it is possible to form multi-level dots with a simple control of a sub-scan driving control unit without changing the driving waveform during a main scan. The driving waveform may be changed by simply varying the driving voltage.

Next, a printing head driving circuit and a sub-scan driving control unit according to a fifth embodiment of the present invention will be described in detail with reference to FIG. 26.

According to this embodiment, similar to the above-mentioned fourth embodiment, a volume of discharged ink for a pixel in at least one scan operation from among a plurality of scan operations is made different from a volume of discharged ink for the pixel in the other scan operations. In the fifth embodiment according to the present invention, a time constant adjusting circuit 113 is provided, which adjusts a rising-time constant "tr" of a driving waveform generated by the waveform generating circuit 101 according to a counted value of the scanning number counter 106 by changing the charging resistance ra or the condenser Ck shown in FIG. 7.

That is, since the volume of discharged ink, Mj, is in inverse proportion to waveform rising time, it is possible to make a driving waveform of at least one scan of a plurality of scans different from the waveform of other scans by controlling a driving waveform rising time.

Figure 27A:
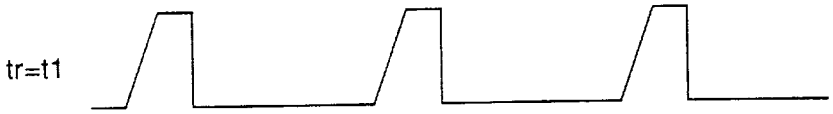
FIG. 27A is a diagram for explaining a driving waveform which is output from the head driving circuit according to the fifth embodiment of the present invention.
Figure 27B:
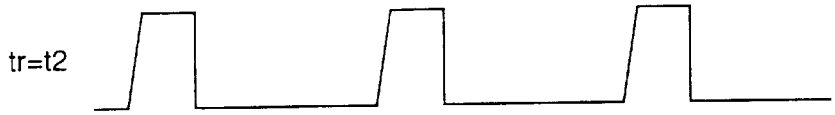
FIG. 27B is a diagram for explaining a driving waveform which is output from the head driving circuit according to the fifth embodiment of the present invention.
Figure 27C:
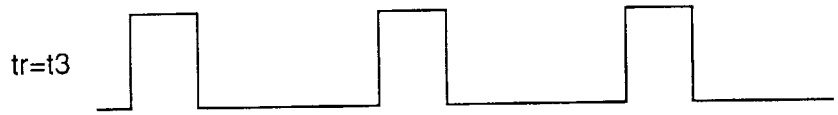
FIG. 27C is a diagram for explaining a driving waveform which is output from the head driving circuit according to the fifth embodiment of the present invention.

Thus, using the time constant adjusting circuit 113, a time constant, by which a driving waveform of rising-time constant tr=t1, is set when a counted value of the scanning number counter 106 is "1" as shown in FIG. 27A, a time constant, by which a driving waveform of rising-time constant tr=t2, is set when a counted value of the scanning number counter 106 is "2" as shown in FIG. 27B, and a time constant, by which a driving waveform of rising-time constant tr=t3, is set when a counted value of the scanning number counter 106 is "3" as shown in FIG. 27C. In this manner, it is possible to achieve three different volume levels of discharged ink, Mj, and multi-level dots may be obtained.

Also, parameters used for controlling the volume of discharged ink are not limited to the above-mentioned driving voltage, Vp, and a rising-time constant, tr, and any parameters, by which the volume of discharged ink may be controlled, such as a pulse width, may be used depending on the structure of the printing head or the type of recording medium.

Moreover, the above-mentioned configuration in which a dot is formed by shifting a deposition position of an ink drop and the configuration in which a dot is formed by decreasing or increasing the volume of discharged ink may be formed independently of each other. Thus, it is possible to employ the two configurations at the same time so that a wider variation of color tones may be obtained. For instance, if it is assumed that the volume of discharged ink and the deposition position of an ink drop are changeable in three levels, respectively, it is possible to form nine levels of dots with nine scanning operation.

When it is desired to vary the volume of discharged ink and the deposition position of an ink drop by changing the driving waveform and the drive or driving timing, the driving voltage shown in FIGS. 25 (or in FIGS. 27) may be generated sequentially at a driving timing shown in FIG. 20 according to a counted value of the scanning number counter using the above-mentioned driving voltage adjusting circuit (or the time constant adjusting circuit) and the drive timing adjusting circuit.

Figure 28:
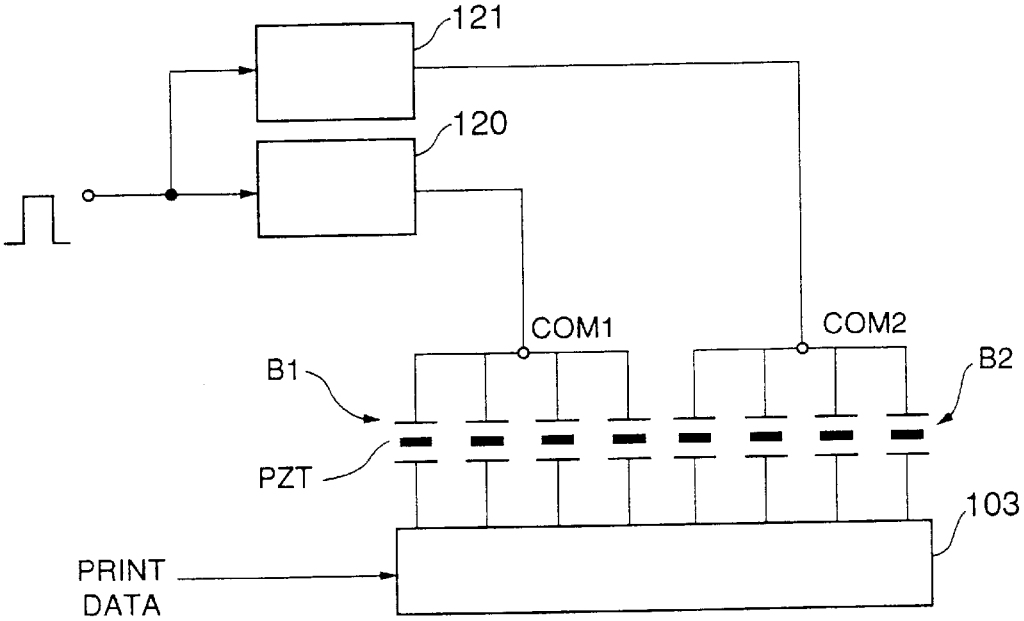
FIG. 28 is a block diagram of a head driving circuit according to a sixth embodiment of the present invention.

Next, a printing head driving circuit according to a sixth embodiment of the present invention will be described in detail with reference to FIG. 28.

According to this embodiment, the plurality of heads or the plurality of nozzles of the recording head used in the above-explained fourth or fifth embodiment are divided into blocks so that ink drops may be discharged from the nozzles of the same block at a different driving timing or different driving waveform from the nozzles of the different blocks.

In this embodiment, a plurality of piezoelectric elements PZT corresponding to a plurality of nozzles of a recording head are divided into two blocks, B1 and B2, and a constant voltage driving circuit 120 connected to a common electrode COM1 of each of the piezoelectric elements PZT in the block B1 and a constant voltage driving circuit 121 connected to a common electrode COM2 of each of the piezoelectric elements PZT in the block B2 are provided.

Figure 26:
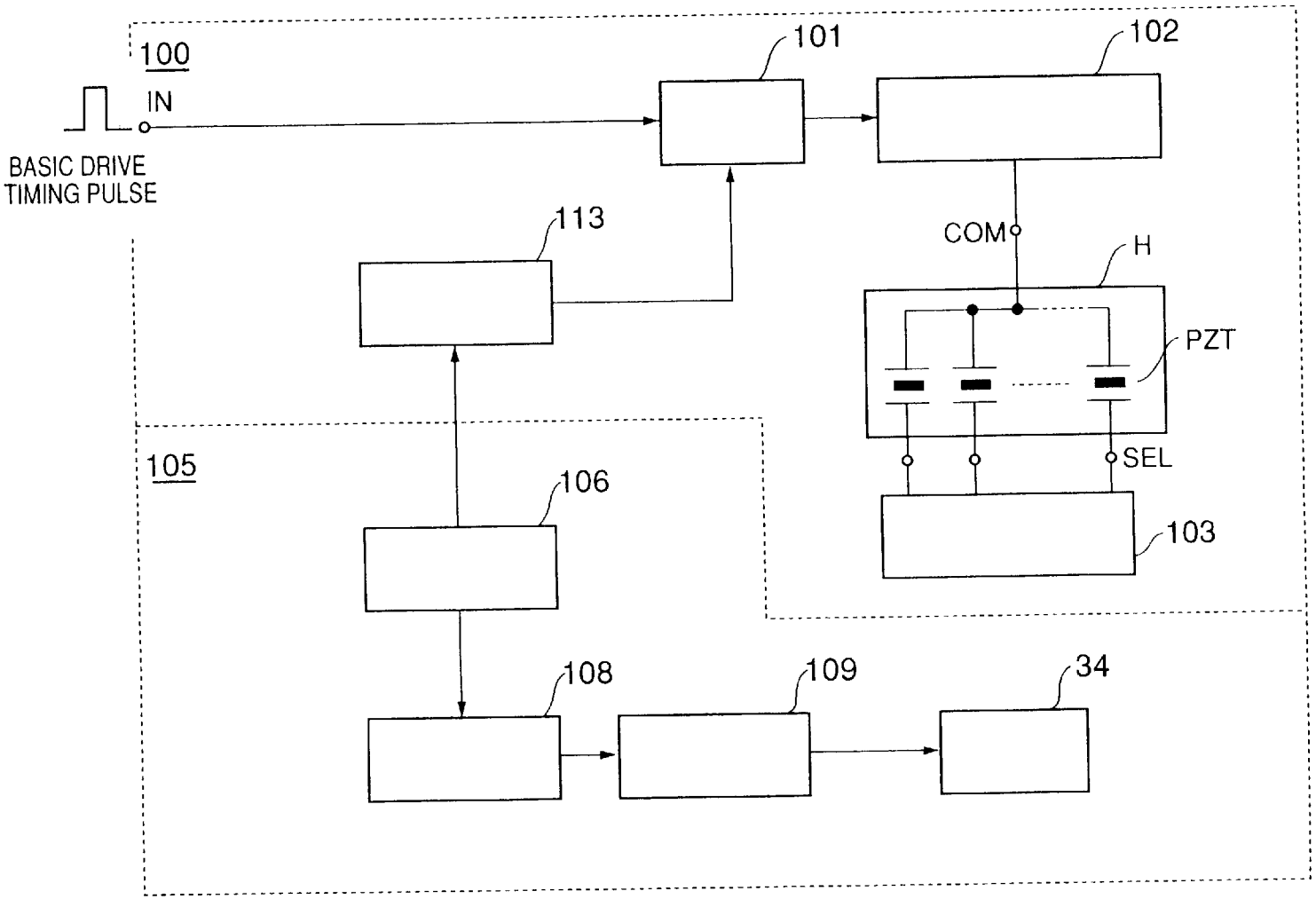
FIG. 26 is a block diagram showing a head driving circuit and a sub-scan driving control circuit according to a fifth embodiment of the present invention.

The constant voltage driving circuits 120 and 121, respectively, may be comprised of, in addition to the waveform generating circuit 101 and the low-impedance output circuit 102, the drive timing adjusting circuit 110 as shown in FIG. 15 when the driving timing is changed, or the driving voltage adjusting circuit 112 as shown in FIG. 23 or the time constant adjusting circuit 113 as shown in FIG. 26 when the driving waveform is varied. It is also possible that the constant voltage driving circuits 120 and 121 include both the drive timing adjusting circuit 110 and the driving voltage adjusting circuit 112 or the time constant adjusting circuit 113.

As for the division of a plurality of nozzles into blocks, it may be possible to form one block with one column of nozzles when a plurality of nozzle columns are present as in the case of the recording head 5. If there is only one nozzle column present as in the case shown in FIG. 9, the nozzles "a" to "d" may form one block, for example, and the nozzles "e" to "h" may form another block. Also, if a plurality of nozzle columns is formed by a recording head having a plurality of head units, it is possible to form one block using one head unit and another block using another head unit.

According to the above embodiment of the present invention, since a plurality of nozzles (actuator elements) is divided into a plurality of blocks and the constant voltage driving circuits 120 and 121 are provided with each block, it becomes possible to carry out a printing operation using a different driving waveform and/or a drive timing for each block during one scans. Therefore, the number of scan required for producing an image may be reduced.

In addition, although the explanation of the above-mentioned present invention has been made with reference to cases in which the present invention is applied to a recording device including an ink-jet printing head which utilizes a piezoelectric element as an actuator element, the present invention may also be applied to a recording device which employs a heating resistant as an actuator element, or a recording device using other types of ink-jet printing heads.

Also, the structure of the printing head driving circuit or the driving waveforms are not limited to the ones explained in the above embodiments and any structure of the printing head driving circuit may be utilized as long as the ink drops are discharged in a stable condition by the circuit and any waveform such as a triangle waveform or sine waveform may be used as a driving waveform. Moreover, although the above embodiments are described with reference to cases in which a printing head is scanned unidirectionally, the present invention may also be applied to a bidirectional scanning.

Figures 29A, 29B, 29C, 29D:
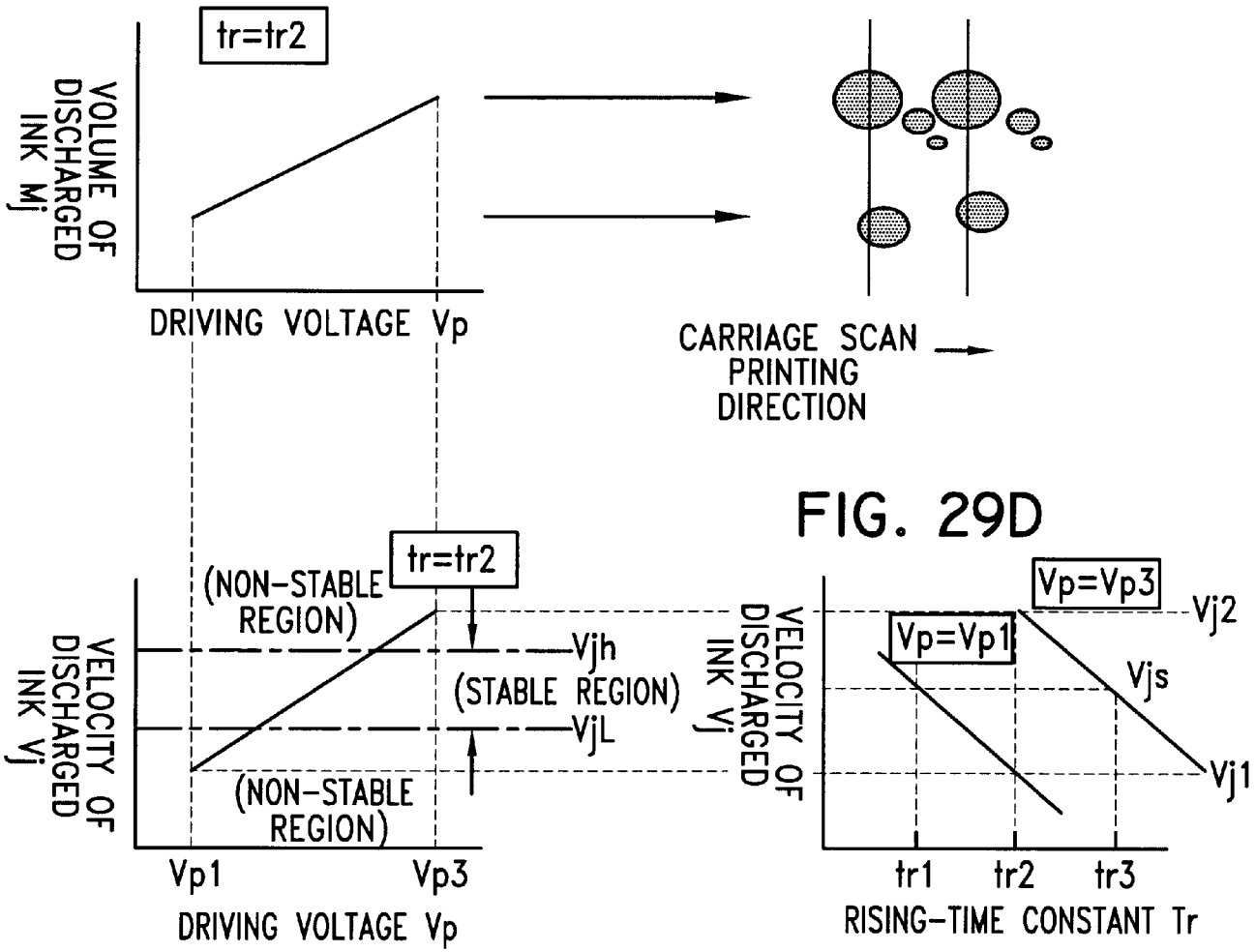
FIG. 29A is a graph showing a relationship between a volume of discharged ink, Mj, and a driving voltage, Vp.
FIG. 29B is a diagram showing a relationship between a volume of discharged ink, Mj, and a driving voltage, Vp and a dot size.
FIG. 29C is a graph showing a relationship between a velocity of discharged ink, Vj, and a driving voltage, Vp, and a stable region and non-stable regions.
FIG. 29D is a graph showing a relationship between a velocity of discharged ink, Vj, and a rising-time constant, tr.
Figure 30:
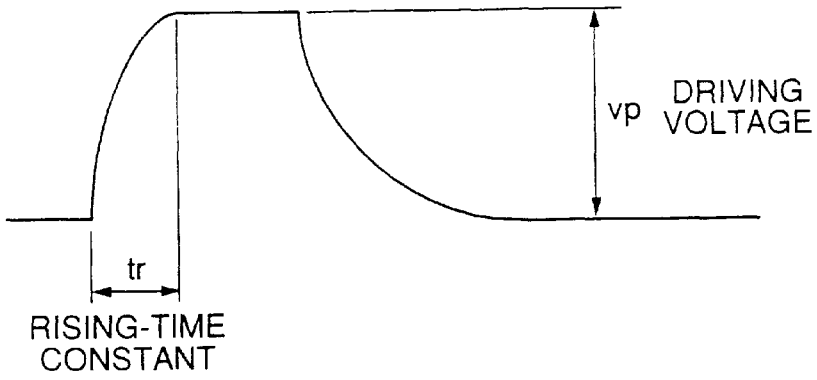
FIG. 30 is a diagram showing an example of a driving waveform by which a piezoelectric element is actuated accordingly.

FIGS. 29A through 29D are diagrams for explaining a principle of an operation according to the present invention and FIG. 30 is a diagram showing a driving waveform applied to piezoelectric elements (when d33 displacement of PZT is used as an actuator). The present invention will be described, hereinafter, for a case in which a dot size is changed for achieving a multi-level color tone.

FIGS. 29A and 29B are diagrams showing a relationship between a volume of discharged ink, Mj, and a driving voltage, Vp. As shown in FIGS. 29A and 29B, it is necessary to set a high voltage, Vp, of a driving waveform in order to produce a dot of larger size, and it is required to use a low voltage, Vp, to form a dot of smaller size.

On the other hand, as shown in FIG. 29C, although the velocity of discharged ink, Vj, is increased when the driving voltage, Vp, is increased, there is a possibility that satellite ink drops are generated in the region of Vj>Vjh. Also, air bubbles may be introduced from nozzles in that region and ink drops may be discharged in an unstable condition. Moreover, if the Vp is lowered, Vj is slowed down and the direction of ink discharge may be changed in the Vj<Vj1 region and a deposition position of an ink drop will be shifted. When the driving voltage, Vp, is high, although dot size is increased, satellite ink drops may attach to a recording medium and image quality may be lowered. Further, when the driving voltage, Vp, is low, positioning accuracy of a dot may be reduced.

According to the present invention, the rising-time constant, tr, may be varied in accordance with the driving voltage, Vp, so that the velocity of discharged ink, Vj, may stay within a stable region Vj1<Vj<Vjh even when the driving voltage, Vp, is changed. In FIG. 29C, the driving voltage is unstable both when Vp=Vp1 and when Vp=Vp3. On the other hand, as shown in FIG. 29D, since the velocity of discharged ink, Vj, is reduced when the rising-time constant, tr, is increased, it is possible to set the velocity of the discharged ink, Vj, within the stable region by selecting the rising-time constant, tr, using the respective driving voltage, Vp. Thus, tr=tr1 is set when Vp=Vp1, and tr=tr3 is set when Vp=Vp3 (Vp1<Vp3, and tr1<tr3).

Figure 31:
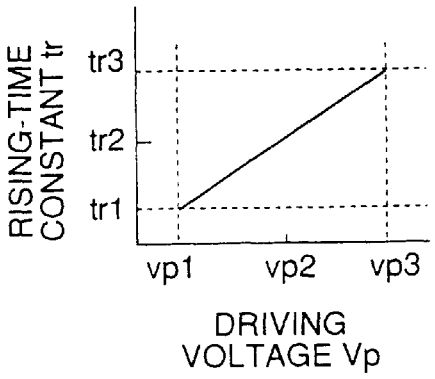
FIG. 31 is a graph showing a relationship between a rising-time constant, tr, and a driving voltage, Vp.

Therefore, by dependently setting the rising-time constant, tr, in accordance with the driving voltage, Vp, as shown in FIG. 31, it is possible to achieve an ink discharging operation with stable ink particles even if dot sizes are varied by Vp.

Figure 32:
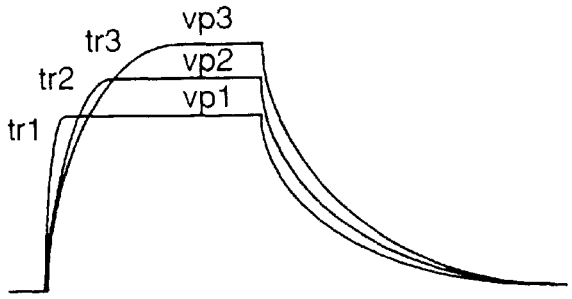
FIG. 32 is a diagram showing examples of waveforms of a piezoelectric element driving voltage.

FIG. 32 is a diagram showing examples of driving waveforms according to the present invention. As shown in FIG. 32, the rising-time constant tr1 is increased to tr3 when the driving voltage Vp1 is increased to Vp3.

The application of the present invention is not limited to the above case in which the dot sizes are changed, and the invention may be applied in accordance with a control mode as shown in TABLE 1. For instance, as shown in TABLE 1, the present invention may be applied to control a driving voltage or a rising-time constant when a volume of discharged ink is varied in accordance with the type of recording medium, when a dot size is switched in accordance with a resolution, when a volume of discharged ink is changed depending on use of a black ink and a colored ink, or when the ink discharging characteristics are corrected by driving waveforms in accordance with environmental temperature.

Note that the relationship among Vps in each control mode shown in TABLE 1 is merely general examples and, for instance, if Vp11>Vp12 >Vp13, then tr11>tr12>tr13 from the relationship shown in FIG. 31 depending on the structure of a printing head and a property of the ink used. In addition, the relationship may be applicable to correct the deviation of ink discharging properties among printing heads or nozzles using driving waveforms.

TABLE 1

| CONTROL MODE | Vp | tr | |
|---|---|---|---|
| Paper Type | | | |
| Normal | Vp13 | tr13 | Vp13 > Vp12 > Vp11 |
| Special | Vp12 | tr12 | tr13 > tr12 > tr11 |
| OHP | Vp11 | tr11 | |
| Resolution | | | |
| High | Vp21 | tr21 | Vp23 > Vp21 |
| Low | Vp23 | tr23 | tr23 > tr21 |
| Color print | | | |
| Black head | Vp32 | tr32 | Vp23 > Vp21 |
| Color head | Vp31 | tr31 | tr32 > tr31 |

TABLE 1-continued

| CONTROL MODE | Vp | tr | |
|---|---|---|---|
| Envir. Temp. | | | |
| High | Vp41 | tr41 | Vp43 > Vp42 > Vp41 |
| Normal | Vp42 | tr42 | tr43 > tr42 > tr41 |
| Low | Vp43 | tr43 | |

Figure 33:
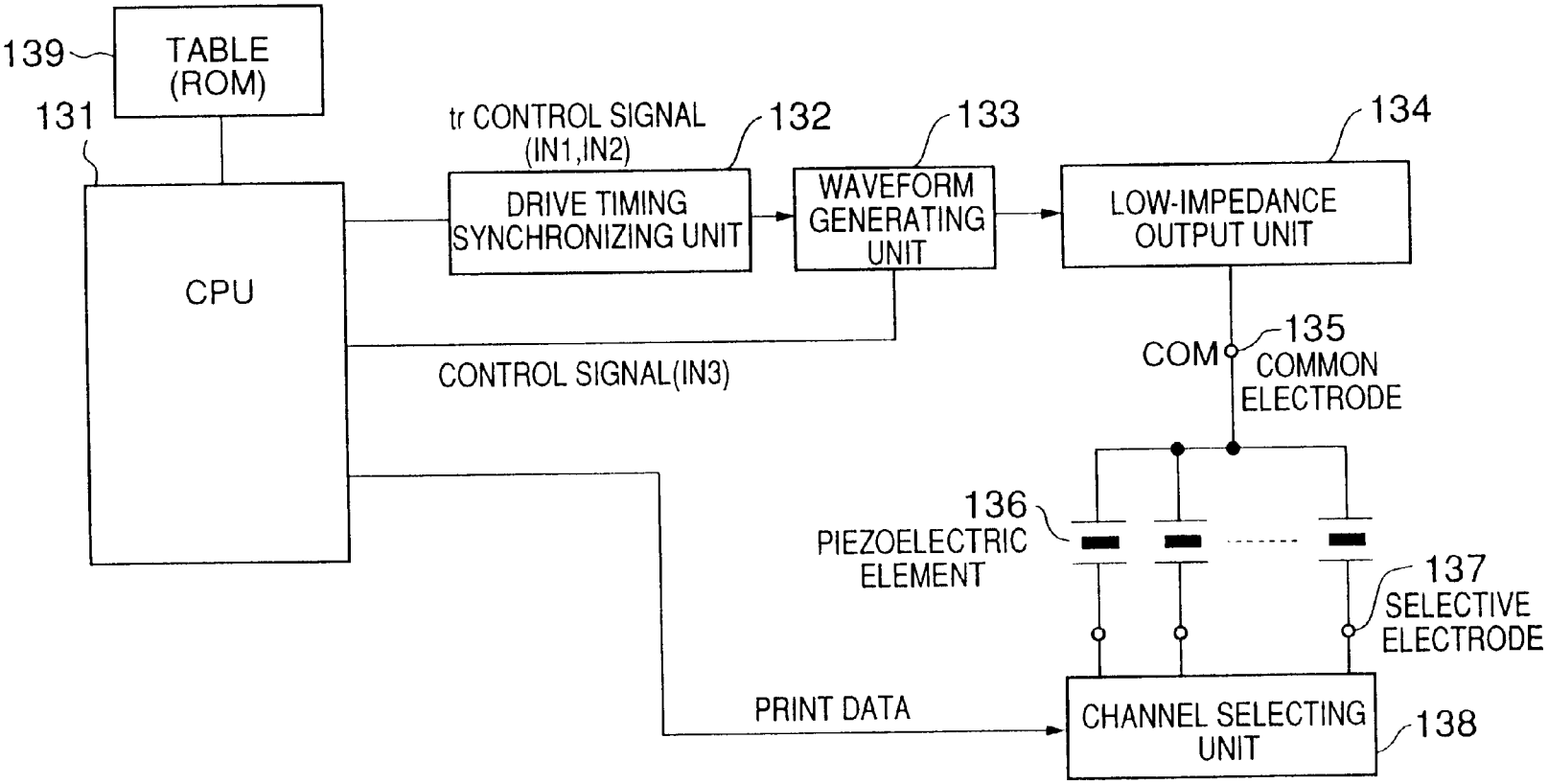
FIG. 33 is a diagram for explaining an embodiment of a piezoelectric element actuating circuit according to the present invention.

FIG. 33 is a block diagram showing a PZT driving circuit according to an embodiment of the present invention. In FIG. 33, the driving circuit is comprised of a CPU 131, a driving timing synchronize unit 132, a waveform generating circuit 133, a low-impedance output unit 134, a common electrode 135, piezoelectric elements (PZT) 136, selective electrodes 137, a channel selecting unit 138, and a ROM which stores the TABLE (TABLE 1) 139. The waveform generating circuit 133 is comprised of a ROM, a D/A converter or another pulse generating circuit and an integrating/differentiating circuit, and a wave-shaping circuit such as a clipping circuit and a clamping circuit. When a basic timing pulse for actuating the PZT is input through an input terminal, Vp and tr of a driving waveform generated in the waveform generating circuit 133 is dependently varied by a Vp control circuit and a tr control circuit and is applied to the common electrode, Com, of a printing head having one channel or a plurality of channels of piezoelectric elements through the low-impedance output unit 134 which may be comprised of a buffer amplifier and a SEPP.

On the other hand, the channel selecting unit 138 may be comprised of a shift register circuit, a latch circuit, and a transistor and a diode array connected to each of the selective electrodes (Sel), and selects each of the channels. Thus, the same waveform generated in the waveform generating circuit 133 is applied to the piezoelectric elements of a selected channel.

In addition, it is known that the waveform is not strained by the difference in the piezoelectric elements and the number of the driving channels in FIG. 33 since the output of the driving waveform is a low-impedance output with respect to the printing head.

Figure 34:
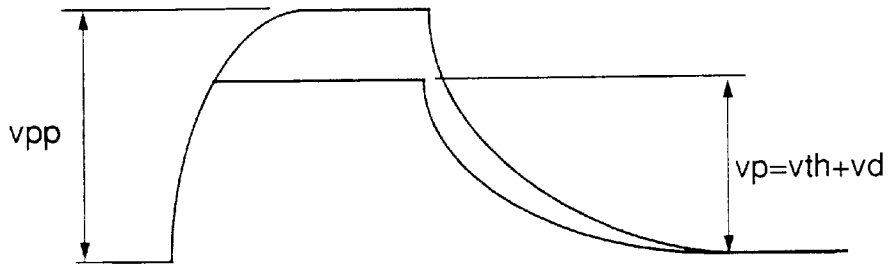
FIG. 34 is a diagram showing a driving voltage waveform for explaining a principle of piezoelectric element actuating voltage generation.
Figure 35:
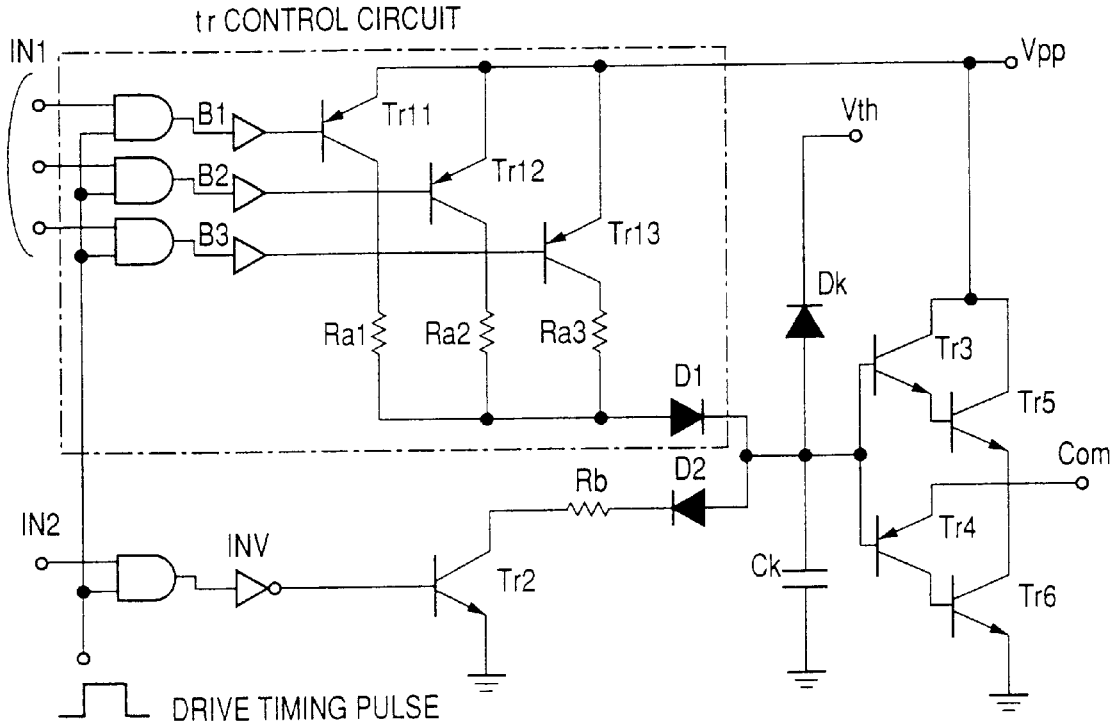
FIG. 35 is a diagram showing an example of a waveform generating circuit for generating the driving voltage waveform shown in FIG. 34.
Figure 36:
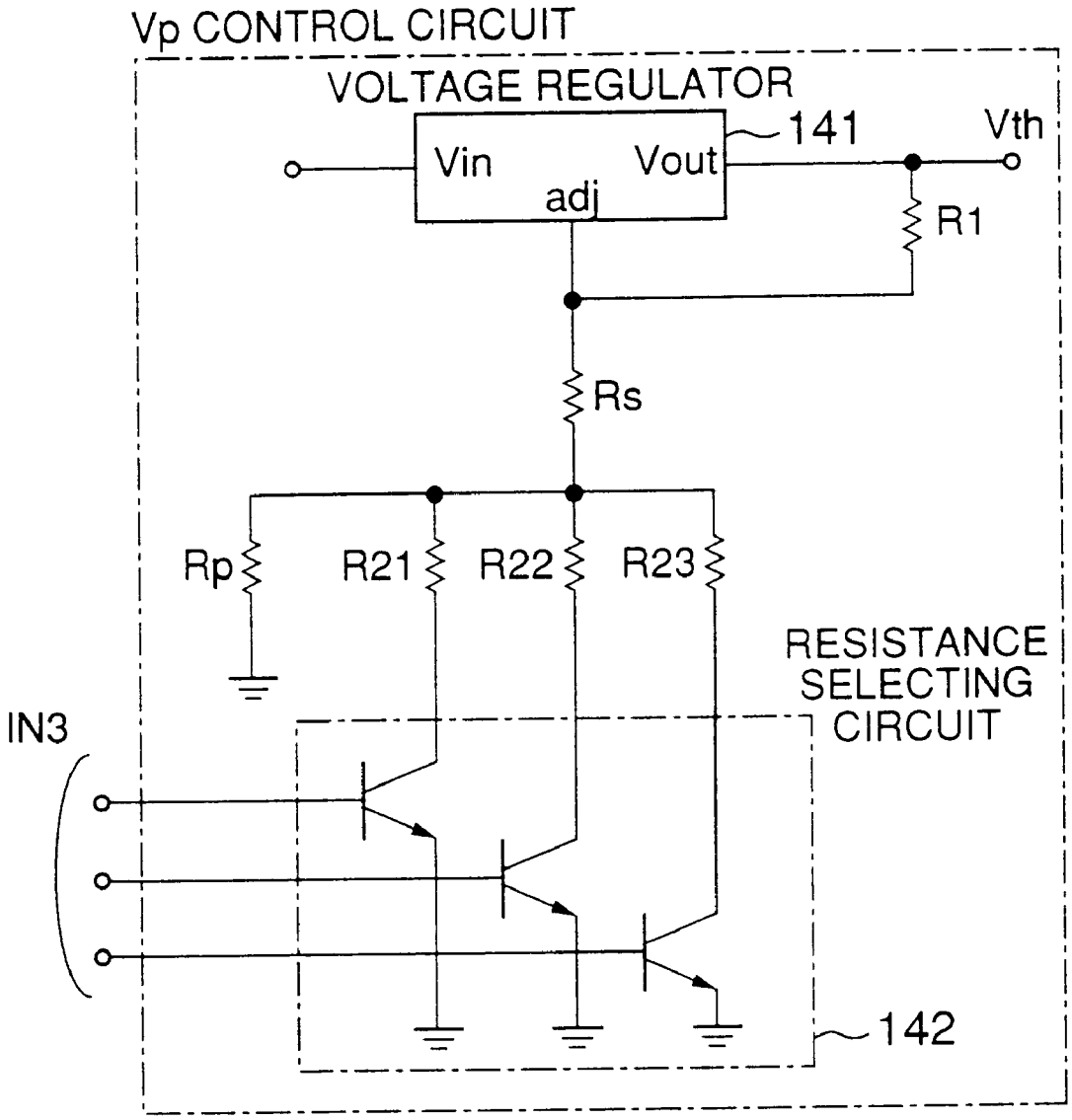
FIG. 36 is a diagram showing an example of a low-impedance output circuit for generating the driving voltage waveform shown in FIG. 34.

FIGS. 35 and 36 are diagrams showing a constant voltage driving circuit (a waveform generating unit and a low-impedance output unit, respectively) according to the present invention for generating driving waveforms shown FIG. 34.

When a Hi level of 3 bits is input to one of the input terminals IN1 shown in FIG. 35, the selected buffer B1 to B3 outputs a voltage having a level lower than the source voltage Vpp and turns on the corresponding transistors Tr11 to Tr13. When the transistors Tr11 to Tr13 are turned on, the condenser Ck is charged by a time constant determined by the resistances Ra1 to Ra3 and the condenser Ck. Thus, it is possible to charge the condenser Ck using one of eight different rising-time constants according to the input bit. At this time, the charging voltage is not raised to the source voltage Vpp and the PZT driving voltage is clipped to Vp by the diode Dk (falling voltage Vd) and Vp becomes equal to Vth+Vd as shown in FIG. 34.

Also, when discharged, the transistors Tr11 to Tr13 are turned off since the IN1 level goes to a Low level and the output of the buffer B becomes equal to Vpp. Since the level of IN2 is normally a Hi level, the output of the inverter IN1 becomes a Hi level when the IN1 level is Low, and the transistor Tr2 is turned on. Then, the condenser Ck, which is charged to the Vp level, starts discharging at a time constant determined by the resistance Rb and the condenser Ck.

FIG. 36 is a diagram showing an embodiment of a circuit of the source Vth which controls the driving voltage Vp. In FIG. 36, a 3-terminal voltage regulator (for instance, LM317T, produced by National Semiconductor Co.) 141 outputs an output voltage $V_{out}$ determined by the following equation when a proper constant voltage source is supplied to a $V_{in}$:

$$V_{out}=1.25\times(1+R2/R1) \quad (1)$$

where R2 is a total resistance of R21 to R23 selected by a resistance selecting circuit 142 (for instance, SN7406, Texas Instruments Co.,), Rp and Rs.

Thus, the output voltage $V_{out}$ may output eight levels of voltage according to input bit information from IN3 of the resistance selecting circuit 142. It is possible to generate the driving voltage Vp as shown in FIGS. 32 and 34 by using the $V_{out}$ as the Vth shown in FIG. 35.

The tr control signals IN1 and IN2 and the Vp control signal IN3 are controlled by the CPU1 and the CPU1 outputs the tr control signals IN1 and IN2 and the Vp control signal IN3 so that the relationship between the Vp and the tr shown in FIG. 31 is maintained in each of the control modes shown in TABLE 1. The IN1 and the IN2 are synchronized with the piezoelectric element actuating timing by the AND circuit and the IN3 is a signal corresponding to a respective control mode. Also, each of the modes shown in TABLE 1 is set automatically or manually by a user and the CPU1 transmits the control signals to the waveform generating unit 133 with reference to a table (ROM) which is prepared beforehand. The low-impedance output circuit 134 is comprised of transistors Tr3 to Tr6 and connected to a printing head via the Com terminal. Thus, each channel of the PZT selected by the channel selecting unit 138 may be driven by the waveform having a shape as shown in FIG. 32 which is generated in the waveform generating unit 133.

Figure 37:
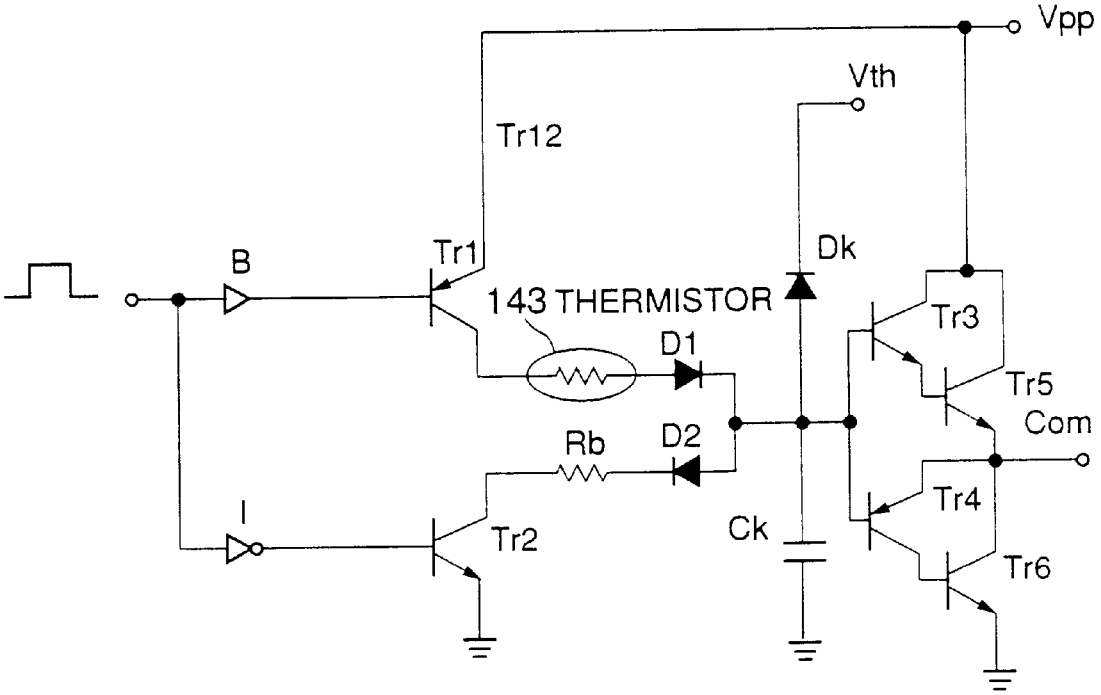
FIG. 37 is a diagram showing another example of a waveform generating circuit for generating the driving voltage waveform shown in FIG. 34.
Figure 38:
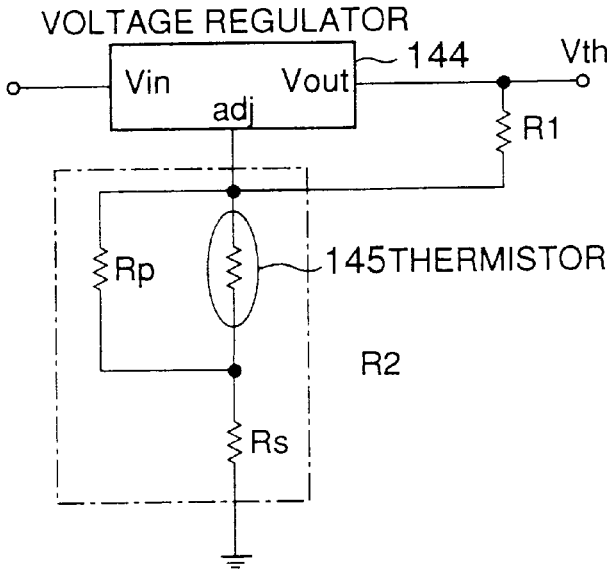
FIG. 38 is a diagram showing another example of a low-impedance output circuit for generating the driving voltage waveform shown in FIG. 34.

FIG. 37 is a diagram showing an embodiment of a circuit which may be used in another driving waveform generating unit according to the present invention. According to this circuit, the Vth which determines the voltage level Vp of a driving waveform is given by an output $V_{out}$ of a voltage regulator 144 shown in FIG. 38. In FIG. 38, when temperature is decreased, a total resistance R2 is increased since a resistance value of a thermistor (negative resistance) 143 is increased. Therefore, as shown in the above equation (1), $V_{out}$ (Vth) is increased and the driving voltage is also increased. On the other hand, the rising-time constant, tr, of the driving voltage waveform is determined by the thermistor 143 and the Ck shown in FIG. 37. That is, since a time constant is increased when temperature is decreased, the rising-time constant, tr, is increased. Thus, it is possible to dependently vary the Vp and tr in accordance with environmental temperature by using the thermistor.

Figure 39:
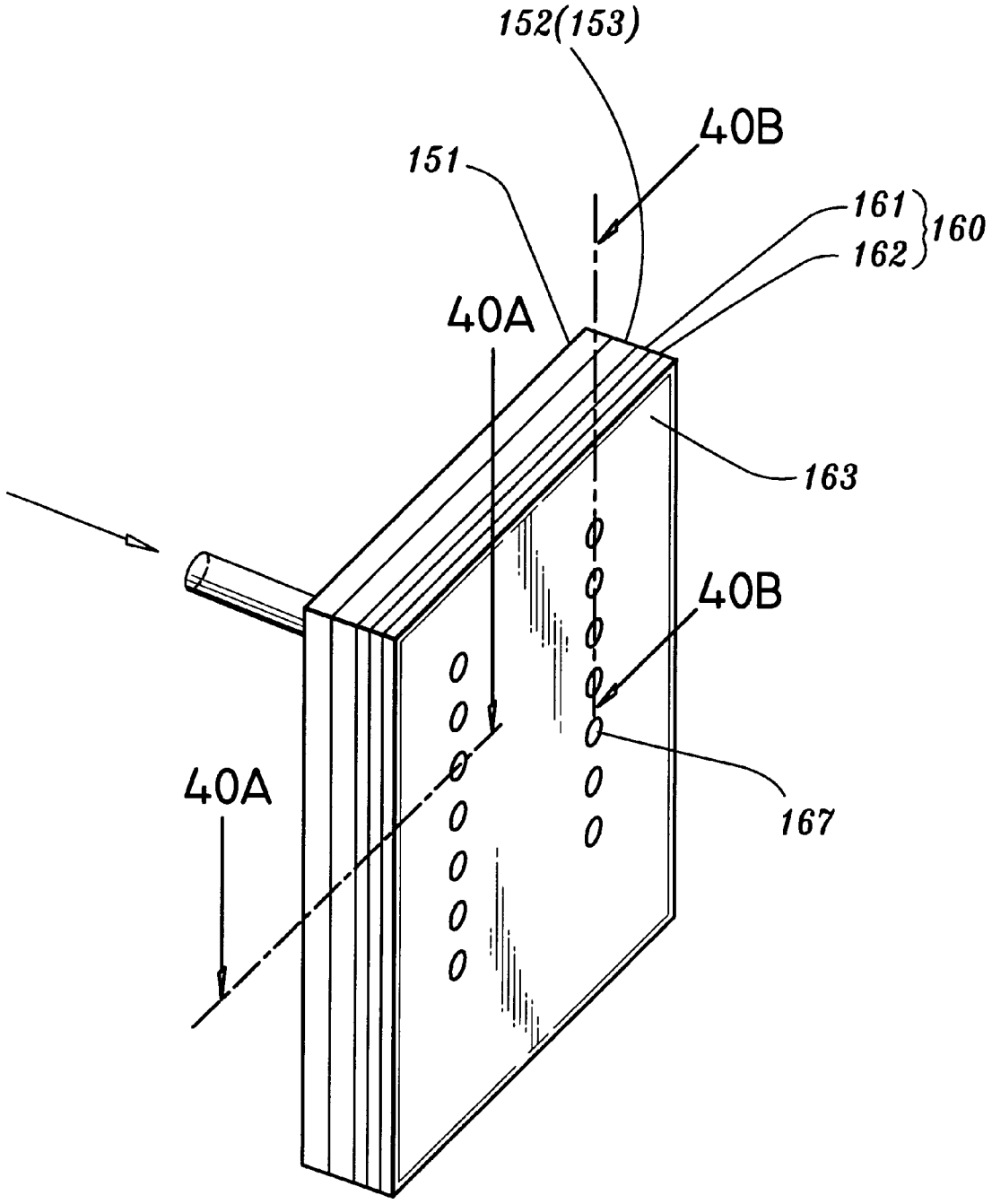
FIG. 39 is a diagram showing a perspective view of an ink-jet printing head to which the present invention may be applied.
Figure 40A:
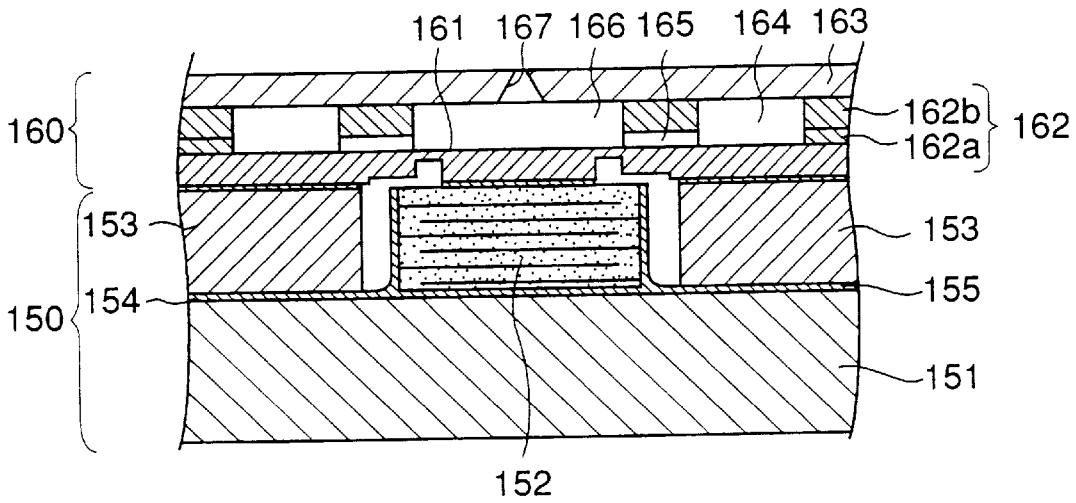
FIG. 40A is a diagram showing a cross-sectional view of the ink-jet printing head cut along the 40A—40A line shown in FIG. 39.
Figure 40B:
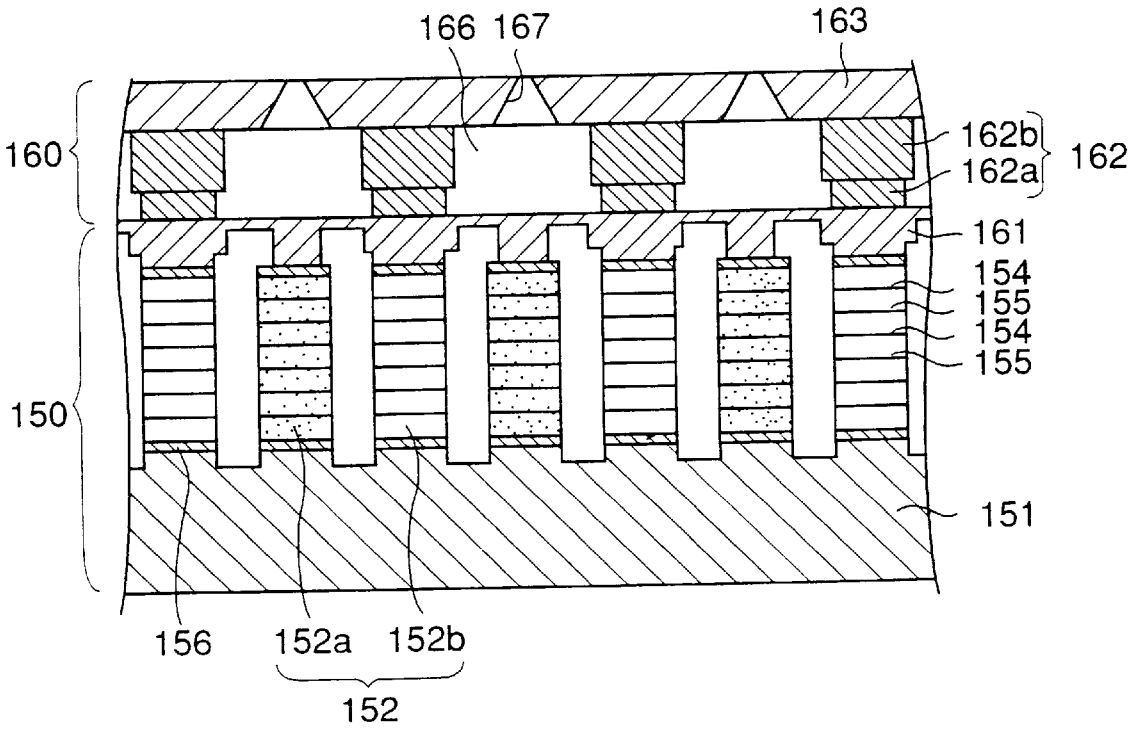
FIG. 40B is a diagram showing a cross-sectional view of the ink-jet printing head cut along the 40B—40B line shown in FIG. 39.

FIG. 39 is a perspective view of an ink-jet printing head using the present invention. FIG. 40A is a diagram showing a cross-sectional view of the ink-jet printing head cut along the 40A—40A line shown in FIG. 39. FIG. 40B is a diagram showing a cross-sectional view of the ink-jet printing head cut along the 40B—40B line shown in FIG. 39.

In the figures, the ink-jet printing head is comprised of an actuator unit and an ink chamber unit 160. The actuator unit 150 includes a substrate 151, a PZT actuator 152 (driving portion 152*a* and non-driving portion 152*b*), a frame 153, a common electrode 154, a selective electrode 155, and insulative layers 156 and 157. The ink chamber unit 160 is comprised of an oscillation plate (Ni electroforming) 161, a diaphragm (dry film resist 162*a* and 162*b*) 162, a nozzle plate 163, a common ink chamber 164, an ink inlet 165, an ink chamber 166 and nozzles 167. The actuator 162*a* is driven by the driving voltage Vp as mentioned above so that ink contained in the ink chamber 166 is pressurized. Thus, ink drops are discharged from the nozzles 167 which are in communication with the ink chamber 166 and ink dots are formed on a recording medium.

Although the above embodiment is explained for a case in which a D33 mode PZT is used for a printing head, it is possible, when a printing head has a structure in which ink is ejected during a decreasing driving waveform such as when using a D31 mode PZT, to dependently change tf, instead of tr, in accordance with Vp. In this case, Rb shown in FIG. 35 is made variable. Also, driving waveforms which may be generated by the waveform generating unit are not limited to ones shown in FIG. 32 and triangular or trapezoidal waveforms may be employed to control the voltage level and its time constant to discharge ink drops.

In addition, it is clear that the present invention is not limited to the above-mentioned embodiments, and variations and modifications may be made without departing from the scope of the present invention.

What is claimed is:

1. An ink-jet printing device comprising:

a recording head movable in a main scanning direction for recording an image on a recording medium:

a generator for generating a driving voltage waveform with a voltage value for driving said recording head;

a feeding mechanism for feeding said recording medium in a sub-scanning direction;

first means for recording said image on said recording medium by moving said recording head in said main scanning direction and feeding said recording medium in said sub-scanning direction; and second means for controlling said voltage value of said driving voltage waveform used for driving said recording head so that said voltage value of said driving voltage waveform is a same value through a scan of moving of said recording head in said main scanning direction and is different between different scans of moving of said recording head in said main scanning direction.

2. The ink-jet printing device as recited in claim 1, wherein said recording head comprises a plurality of head units, said plurality of head units are divided into a plurality of blocks, and said second means controls a driving timing of said plurality of head units for each of said blocks in a manner in which said driving timing is a same value through said scan of moving of said recording head in said main scanning direction and is different between different scans of moving of said recording head in said main scanning direction.

3. The ink-jet printing device as recited in claim 1, wherein said recording head comprises a plurality of nozzles, said plurality of nozzles are divided into a plurality of blocks, and said second means controls a driving timing for said plurality of nozzles for each of said blocks in a manner in which said driving timing is a same value through said scan of moving of said recording head in said main scanning direction and is different between different scans of moving of said recording head in said main scanning direction.

4. The ink-jet printing device as recited in claim 1, wherein ink drops are ejected by said recording head onto said recording medium and are superimposed on each other during a plurality of scans of said recording head.

5. The ink-jet printing device as recited in claim 4, wherein said second means controls said voltage value of said driving voltage waveform such that when said ink drops are ejected by said recording head onto said recording medium ink drops having different sizes are superimposed on each other during said plurality of scans of said recording head.

6. The ink-jet printing device as recited in claim 2, wherein said second means controls said driving timing to shift a deposition position of an ink drop ejected from said recording head for forming a pixel, from a deposition position of other ink drops used for forming said pixel in at least one scan of a plurality of scans of said recording head.

7. The ink-jet printing device as recited in claim 1, wherein said second means controls said voltage value to vary a volume of an ink drop ejected by said recording head for forming a pixel, from a volume of other ink drops used for forming said pixel in at least one scan of a plurality of scans of said recording head.

8. An ink-jet printing device comprising:

a recording head movable in a main scanning direction for recording an image on a recording medium, a generator for generating a driving voltage waveform with a rising time constant for driving said recording head, a feeding mechanism for feeding said recording medium in a sub-scanning direction;

first means for recording said image on said recording medium by moving said recording head in said main scanning direction and feeding said recording medium in said sub-scanning direction; and second means for controlling said rising-time constant of said driving voltage waveform used for driving said recording head so that the rising-time constant of the driving voltage waveform is a same value through a scan of moving of said recording head in said main scanning direction and is different between different scans of moving of said recording head in said main scanning direction.

9. The ink-jet printing device as recited in claim 8, wherein said recording head comprises a plurality of head units, said plurality of head units are divided into a plurality of blocks, and said second means controls a driving timing of said plurality of head units for each of said blocks in a manner in which said driving timing is a same value through said scan of moving of said recording head in said main scanning direction and is different between different scans of moving of said recording head in said main scanning direction.

10. The ink-jet printing device as recited in claim 8, wherein said recording head comprises a plurality of nozzles, said plurality of nozzles are divided into a plurality of blocks, and said second means controls a driving timing for said plurality of nozzles for each of said blocks in a manner in which said driving timing is a same value through said scan of moving of said recording head in said main scanning direction and is different between different scans of moving of said recording head in said main scanning direction.

11. The ink-jet printing device as recited in claim 8, wherein ink drops are ejected by said recording head onto said recording medium and are superimposed on each other during a plurality of scans of said recording head.

12. An ink-jet printing device comprising:

a recording head movable in a main scanning direction for recording an image on a recording medium;

a generator for generating a driving voltage waveform with a voltage value and a rising time constant for driving said recording head;

a feeding mechanism for feeding said recording medium in a sub-scanning direction;

first means for recording said image on said recording medium by moving a recording head in said main scanning direction and feeding said recording medium in said sub-scanning direction; and second means for controlling said voltage value and said rising-time constant of said driving voltage waveform used for driving said recording head so that said voltage value and the rising-time constant of the driving voltage waveform are a same value through a scan of moving of said recording head in said main scanning direction and are different between different scans of moving of said recording head in said main scanning direction.

13. The ink-jet printing device as recited in claim 12, wherein said recording head comprises a plurality of head units, said plurality of head units are divided into a plurality of blocks, and said second means controls a driving timing of said plurality of head units for each of said blocks in a manner in which said driving timing is a same value through said scan of moving of said recording head in said main scanning direction and is different between different scans of moving of said recording head in said main scanning direction.

14. The inkjet printing device as recited in claim 12, wherein said recording head comprises a plurality of nozzles, said plurality of nozzles are divided into a plurality of blocks, and said second means controls a driving timing for said plurality of nozzles for each of said blocks in a manner in which said driving timing is a same value through said scan of moving of said recording head in said main scanning direction and is different between different scans of moving of said recording head in said main scanning direction.

15. The ink-jet printing device as recited in claim 12, wherein ink drops are ejected by said recording head onto said recording medium and are superimposed on each other during a plurality of scans of said recording head.

16. An ink-jet printing apparatus comprising:

a recording head for recording an image on a recording medium;

a carriage having said recording head mounted thereon for moving said recording head in a main scanning direction;

a feeding mechanism for feeding said recording medium in a sub-scanning direction;

a generator for generating a driving voltage waveform with a voltage value for driving said recording head; and a controller for generating and controlling said voltage value of said driving voltage waveform used for driving said recording head so that said voltage value of said driving voltage waveform is a same value through a scan of moving of said recording head in said main scanning direction and is different between different scans of moving of said recording head in said main scanning direction.

17. The ink-jet printing apparatus as recited in claim 16, wherein said recording head comprises a plurality of head units, divided into a plurality of blocks, and said controller controls a driving timing of said plurality of head units for each of said blocks in a manner in which said driving timing is a same value through said scan of moving of said recording head in said main scanning direction and is different between different scans of moving of said recording head in said main scanning direction.

18. The ink-jet printing apparatus as recited in claim 16, wherein said recording head comprises a plurality of nozzles, divided into a plurality of blocks, and said controller controls a driving timing for said plurality of nozzles for each of said blocks in a manner in which said driving timing is a same value through said scan of moving of said recording head in said main scanning direction and is different between different scans of moving of said recording head in said main scanning direction.

19. The ink-jet printing apparatus as recited in claim 16, wherein ink drops are ejected by said recording head onto said recording medium and are superimposed on each other during a plurality of scans of said recording head.

20. The ink-jet printing apparatus as recited in claim 19, wherein said controller controls said voltage value of said driving voltage waveform such that when said ink drops are ejected by said recording head onto said recording medium ink drops having different sizes are superimposed on each other during said plurality of scans of said recording head.

21. The ink-jet printing apparatus as recited in claim 17, wherein said controller controls said driving timing to shift a deposition position of an ink drop ejected from said recording head for forming a pixel, from a deposition position of other ink drops used for forming said pixel in at least one scan of a plurality of scans of said recording head.

22. The ink-jet printing apparatus as recited in claim 16, wherein said controller controls said voltage value to vary a volume of an ink drop ejected by said recording head for forming a pixel, from a volume of other ink drops used for forming said pixel in at least one scan of a plurality of scans of said recording head.

* * * * *